US005875710A

United States Patent [19]

Honda et al.

[11] Patent Number: 5,875,710

[45] Date of Patent: Mar. 2, 1999

[54] VENEER-PRESSING APPARATUS

[75] Inventors: Noriyuki Honda; Yukio Abe; Makoto Isobe, all of Aichi, Japan

[73] Assignee: Meinan Machinery Works, Inc., Aichi, Japan

[21] Appl. No.: 909,821

[22] Filed: Aug. 12, 1997

[30] Foreign Application Priority Data

Aug. 20, 1996 [JP] Japan ..... 8-238544

[51] Int. Cl.[6] ..... B30B 9/00

[52] U.S. Cl. ..... 100/196

[58] Field of Search ..... 34/61, 70, 71, 34/144, 612, 613, 628, 660, 662; 226/109, 110, 171, 172; 100/196, 208, 215, 218; 414/222

[56] References Cited

U.S. PATENT DOCUMENTS

| | | | |
|---|---|---|---|
| 3,896,559 | 7/1975 | Martin . | |
| 3,964,853 | 6/1976 | Fledges et al. | 100/196 X |
| 4,565,481 | 1/1986 | Pagnoni | 100/196 X |
| 4,811,496 | 3/1989 | Honda et al. . | |
| 4,863,552 | 9/1989 | Ishida et al. | 100/218 X |
| 5,560,410 | 10/1996 | Peacock | 144/362 |
| 5,564,199 | 10/1996 | Yamamoto et al. | 34/398 |

*Primary Examiner*—Henry Bennett
*Assistant Examiner*—Steve Gravini
*Attorney, Agent, or Firm*—Armstrong, Westerman, Hattori, McLeland, and Naughton

[57] ABSTRACT

A veneer-pressing apparatus comprising a pressing device provided with at least three pressing bodies disposed movably from a non-pressing position where the pressing bodies are vertically spaced apart from each other to a pressing position where the pressing bodies are close to each other; endless belts each adapted to be intermittently moved in a direction opposite to that of the neighboring endless belt, thereby forming a forward transfer passage between a pair of facing surfaces of the neighboring endless belts and a backward transfer passage which is opposite in transferring direction to the forward transfer passage; and a pressing member which is capable of rendering the pressing bodies provided with the endless belt to move from a non-pressing position to a pressing position to press a veneer with a predetermined pressure. This apparatus further comprises a first transfer means disposed on an upstream side of the forward transfer passage in the pressing device, a transferring direction thereof being the same as the forward transfer passage; and a second transfer means disposed on an upstream side of the backward transfer passage in the pressing device and capable of being moved in both forward and backward directions as well as in vertical direction.

10 Claims, 15 Drawing Sheets

VENEER-PRESSING APPARATUS

BACKGROUND OF THE INVENTION

This invention relates to a veneer-pressing apparatus for simultaneously pressing a plurality of veneers in multistage.

There has been proposed a pressing apparatus for hot-pressing or cold-pressing a single sheet of veneer or a laminated veneer consisting of a plurality of veneers bonded with each other via an adhesive. For example, Japanese Patent Publication S/41-1753 describes an automatic compression apparatus provided with a plurality of pressing means which are arranged vertically and in multistage.

As shown in FIGS. 14 and 15, this apparatus is generally constituted by a pressing device 200, a loader 206 and an unloader 6. This pressing device 200 comprises a plurality of compression plates 203 which are arranged in multistage or spaced apart vertically from each other by a predetermined interval and interposed between a fixed plate 201 and a movable plate 202 which are vertically spaced apart from each other, and metal belt conveyers 204 (FIG. 15), the upper portion of each metal belt conveyer 204 being disposed to move over the compression plates 203 and adapted to be intermittently moved from a loading side to an unloading side. The loader 206 is movably disposed at the loading side so as to be moved up and down and provided with a plurality of conveyers 205 each arranged to correspond with each of the compression plates 203. The unloader 208 is movably disposed at the unloading side so as to be moved up and down and provided, as in the case of the loader 206, with a plurality of conveyers 205 each arranged to correspond with each of the compression plates 203.

Plates 210 to be treated (hereinafter referred to as untreated plates 210) are successively placed on each conveyer while the loader 206 is vertically moved, and each of the conveyers of the loader 206 is aligned with each of the compression plates 203. Under this condition, the conveyers of the loader 206 and the metal belt conveyers 204 are allowed to move whereby transferring the untreated plates 210 on the conveyers onto the metal belt conveyers 204. Then, the movable plate 202 is moved vertically, thereby rendering the compression plates 203 to approach to each other so as to press each of the untreated plates 210 interposed between the compression plates 203. After keeping this pressing treatment for a predetermined period of time, the movable plate 202 is moved downward thereby allowing the space between the compression plates 203 to expand again. Under this condition, the metal belt conveyers 204 and the conveyers 207 of the unloader 208 are allowed to move whereby transferring the plates 210 thus pressed onto each of the conveyers of the unloader 208. Thereafter, the unloader 208 is moved vertically to successively unload the plates 210 from each of the conveyers 208 toward the unloading conveyers 220.

In this automatic compression apparatus however, the transferring surface (or the upper surface portion) 204*a* of each of the metal belt conveyers 204 is designed to be moved always in the direction from the loading side to the unloading side (as indicated by the arrow "a"). In this case, the non-transferring surface 204*b* of the metal belt conveyer 204 which is disposed over the untreated plate 210 is moved in the direction (as indicated by the arrow "b") which is opposite to that of the transferring surface 204*a* of the metal belt conveyer 204. Accordingly, if an edge portion of the untreated plate 210 is warped or bent upward and if such an untreated plate 210 is to be moved forward through a space between the metal belt conveyers 204, the warped or bent edge portion of the untreated plate 210 may be contacted with the non-transferring surface 204*b* of the metal belt conveyer 204 that is disposed over the untreated plate 210 and running in the direction opposite to the transferring direction, thus making it difficult to accurately transfer the untreated plate 210 in a predetermined direction and inviting a cause for a fracture of edge portion of the untreated plate 210.

It may be possible to avoid these problems if the interval between the compression plates 203 is set to a sufficient height. However, if the interval between the compression plates 203 is enlarged in this manner, the height of the apparatus will be increased, making the apparatus bulky as a whole, thus inviting another problem.

Additionally, the aforementioned automatic compression apparatus is accompanied with another problem that when a veneer as an untreated plate is hot-pressed, a sap squeezed out of the veneer due to a pressing of the veneer is likely to be adhered onto the bottom portion of the metal belt conveyer disposed over the veneer and running in a direction opposite to the transferring direction. Therefore, if this metal belt conveyer adhered with the sap is allowed to continue to move for transferring the veneer, the veneer may be transferred back to the loading side instead of being transferred to the unloading side, or may be fractured.

BRIEF SUMMARY OF THE INVENTION

This invention has been made for the purpose of solving the aforementioned problems accompanied with the conventional apparatus, and therefore an object of the present invention is to provide a veneer-pressing apparatus which is capable of accurately transferring a plurality of veneers even if the edge portion of the veneer is curved or bent upward, thereby accomplishing a pressing treatment.

With a view to realize the aforementioned object, this present invention provides a pressing device comprising;

at least three pressing bodies disposed parallel with each other and made movable from a non-pressing position where said pressing bodies are vertically spaced apart from each other by a predetermined interval to a pressing position where said pressing bodies are close to each other;

endless belts each adapted to be intermittently moved along the upper surface and bottom surface of each of said pressing bodies and in a direction which is opposite to that of the neighboring endless belt, thereby forming a forward transfer passage between a pair of facing surfaces of the neighboring endless belts (for example, a veneer-transferring passage of a stage of even number) and a backward transfer passage between a pair of facing surfaces of the neighboring endless belts which is opposite in transferring direction to said forward transfer passage (for example, a veneer-transferring passage of a stage of odd number); and a pressing member which is capable of rendering said at least three pressing bodies provided with said endless belt to move from a non-pressing position where said pressing bodies are vertically spaced apart from each other by a predetermined interval so as to form said forward transfer passage and said backward transfer passage alternately between said pressing bodies to a pressing position where said pressing bodies are close to each other so as to press a veneer carried on each of said transfer passage with a predetermined pressure.

This present invention also provides a veneer pressing apparatus comprising in addition to the aforementioned pressing device;

a first transfer means disposed in conformity with and on an upstream side of said forward transfer passage in said pressing device, a transferring direction of said first transfer means being the same as that of said forward transfer passage; and a second transfer means disposed on an upstream side of said backward transfer passage in said pressing device and capable of being intermittently moved in both forward and backward directions, said second transfer means being also capable of being moved in vertical direction.

This veneer pressing apparatus can be actuated as follows.

First of all, each of the pressing bodies is moved to the non-pressing position, and the second transfer means is kept to conform with the forward passage. Under this condition, the first and second transfer means are allowed to move in the direction conforming to that of the forward passage, and at the same time each of the endless belts is allowed to move whereby transferring a first veneer placed in advance on the first transfer means to the forward transfer passage and then to the second transfer means. Then, the second transfer means carrying the first veneer is vertically move to conform with the backward transfer passage. On the other hand, a second veneer is put in place on the first transfer means until the aforementioned vertical movement of the second transfer means carrying the first veneer to conform with the backward transfer passage is finished. Under this condition, the first transfer means is allowed to move in the direction conforming to that of the forward transfer passage and the second transfer means is allowed to move in the direction conforming to that of the backward transfer passage. At the same time, each of the endless belts is allowed to move whereby transferring the second veneer carried on the first transfer means to the forward transfer passage formed between the pressing bodies, while the first veneer carried on the second transfer means to the backward transfer passage formed between the pressing bodies. Then, the movement of at least the endless belts among the first and second transfer means and the endless belts is suspended. Under this condition, the pressing member is actuated to move the pressing bodies to the pressing position respectively, thereby performing the pressing of the first and second veneers.

DETAILED DESCRIPTION OF THE INVENTION

This invention will be further explained with reference to FIGS. 1 to 11 depicting one embodiment of this invention.

Figure 1:
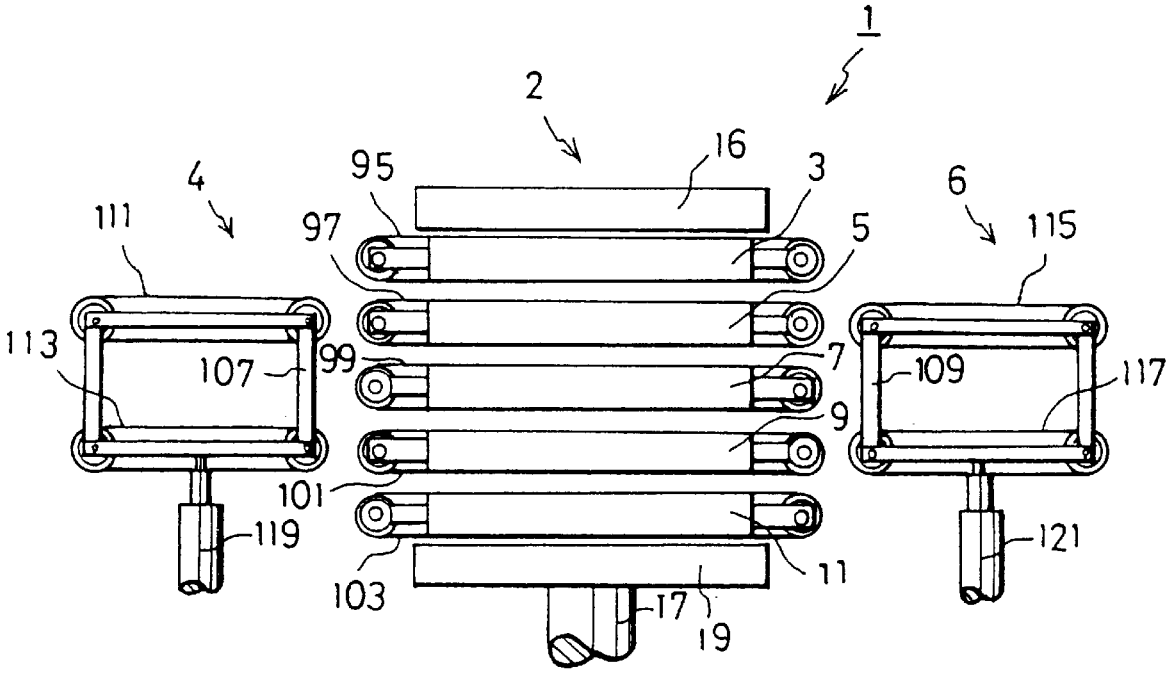
FIG. 1 is a front view schematically showing a veneer-pressing apparatus according to this invention.
Figure 2:
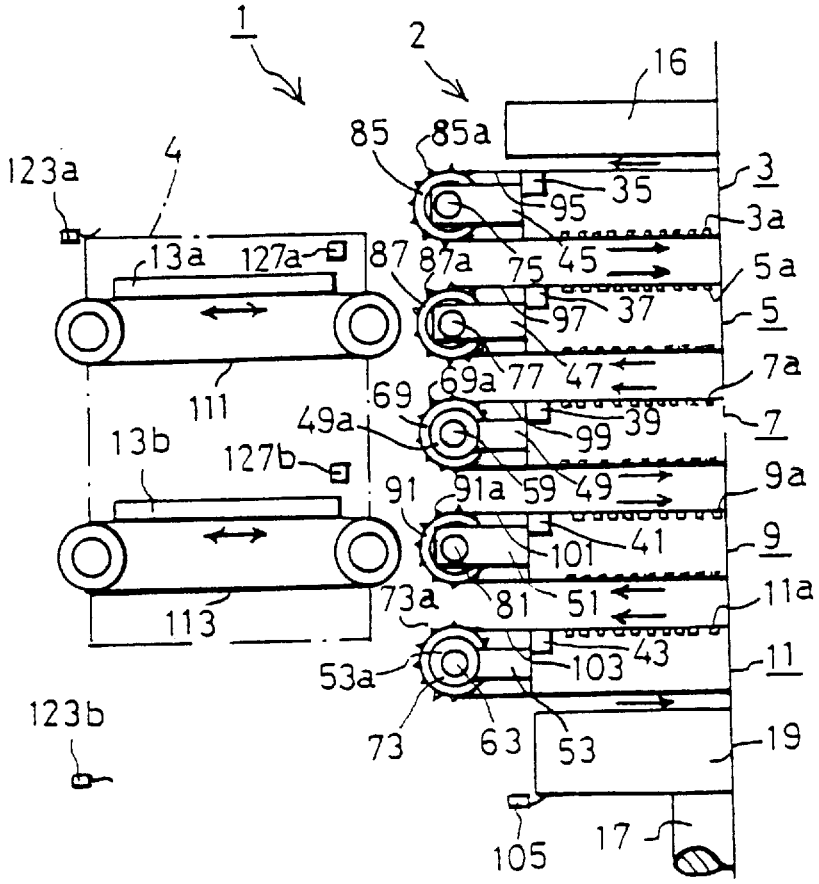
FIG. 2 is an enlarged front view illustrating a left half portion of the veneer-pressing apparatus shown in FIG. 1.
Figure 3:
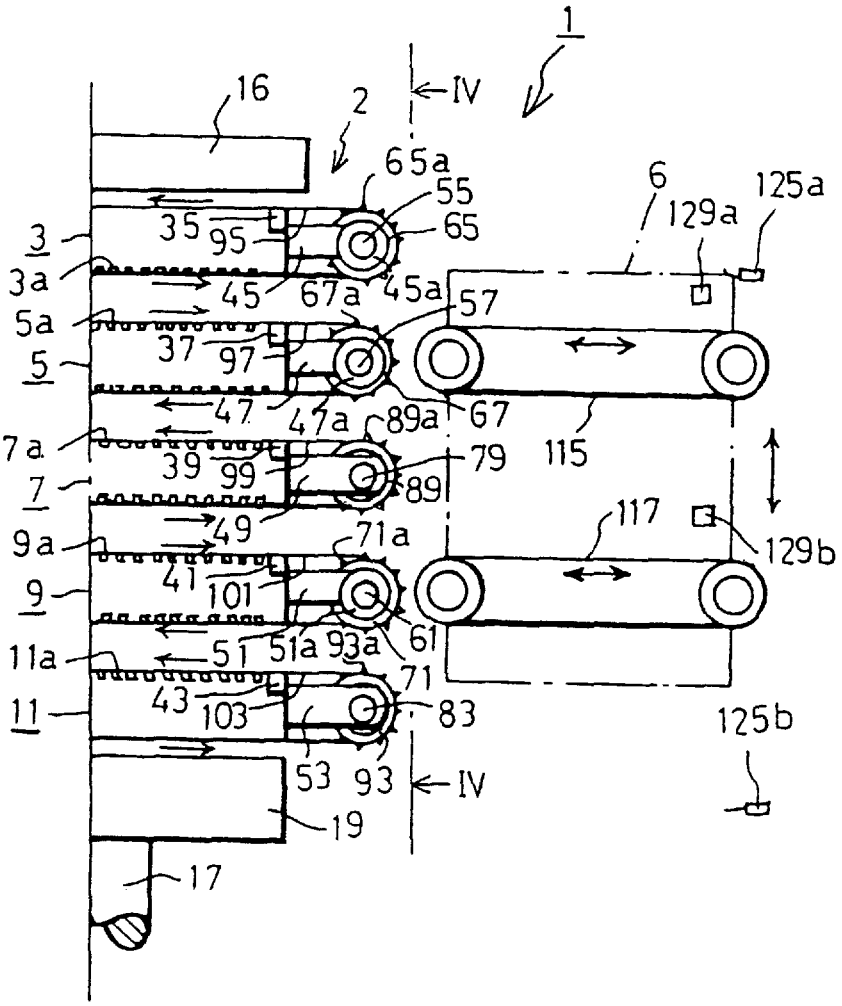
FIG. 3 is an enlarged front view illustrating a right half portion of the veneer-pressing apparatus shown in FIG. 1.
Figure 4:
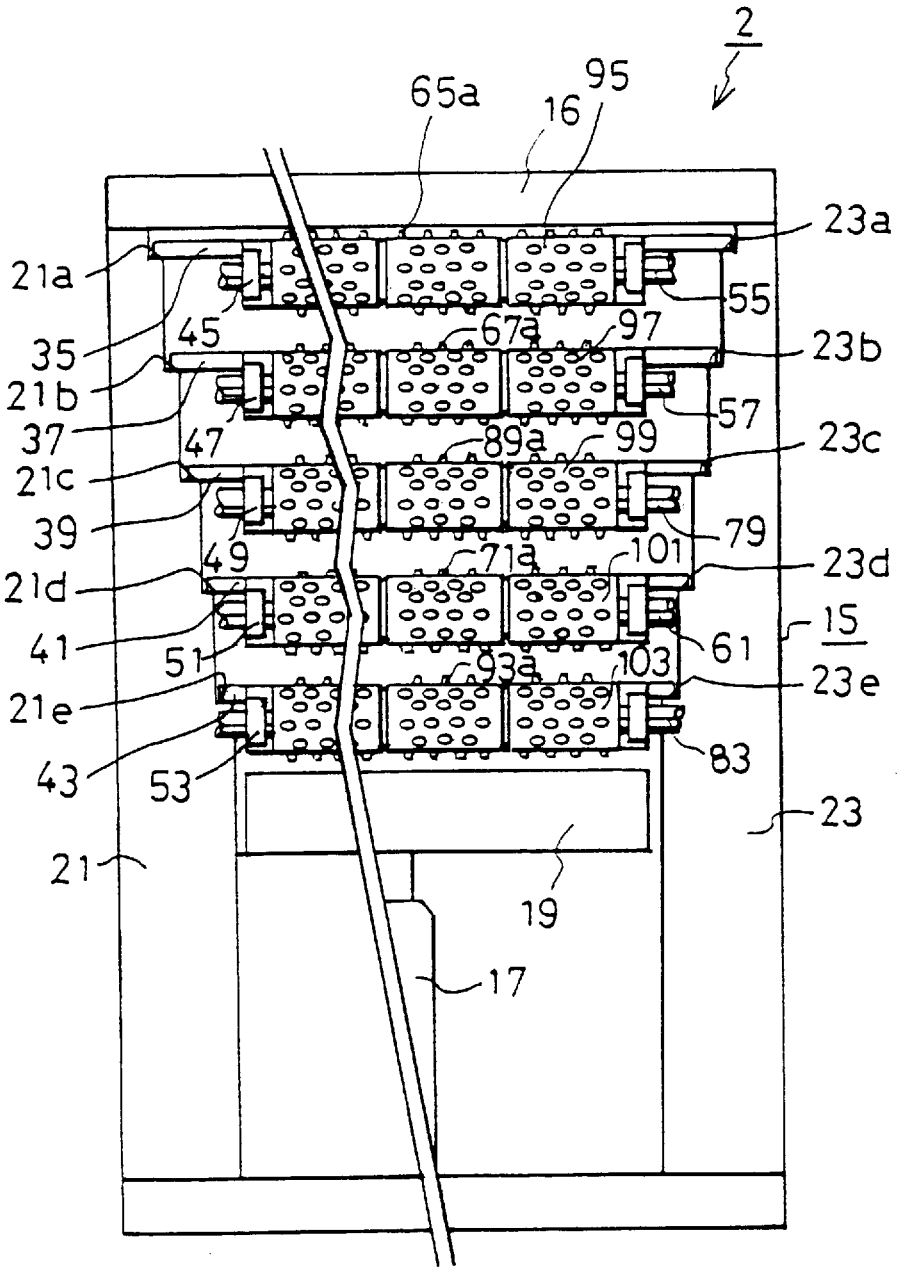
FIG. 4 is a side view of the veneer-pressing apparatus as viewed from the line IV—IV in FIG. 3.

Referring to FIGS. 1 to 5, a veneer-pressing apparatus 1 comprises a multistage pressing device 2, a first transfer device 4 disposed on the left side of the multistage pressing device 2 and a second transfer device 6 disposed on the right side of the multistage pressing device 2 as shown in FIG. 1. The multistage pressing device 2 is designed to press and dry veneers 13*a*, 13*b*, 14*a* and 14*b* by means of pressing bodies 3, 5, 7, 9 and 11. In this multistage pressing device 2, a fixed plate 16 is fixed at the top portion of the main frame 15, and a movable plate 19 is movably attached to the lower portion of the main frame 15. This movable plate 19 is connected with a compression member 17 consisting for example of a hydraulic cylinder and spaced apart from the fixed plate 16 by a predetermined distance. The main frame 15 is provided with a pair of columns 21 and 23 facing to each other on which sustaining portions 21*a* to 21*e* and 23*a* to 23*e* are formed respectively as shown in FIG. 4. These sustaining portions are formed in steps-like, i.e. the distance between a pair of sustaining portions facing each other (e.g. 21*a* to 23*a*) becomes gradually smaller as the location of sustaining portions goes downward from the top of each of columns 21 and 23.

The pressing bodies 3, 5, 7, 9 and 11 are arranged vertically in five stages between the columns 21 and 23, and are adapted to be heated up to about 150° C. by means of heated steam. The heating of each of the pressing bodies 3, 5, 7, 9 and 11 may be performed by an electric heater that can be installed inside each of the pressing bodies 3, 5, 7, 9 and 11 instead of employing heated steam.

Each of the pressing bodies 3, 5, 7, 9 and 11 provided at their corner portions with engagement portions 35, 37, 39, 41 and 43, respectively. These engagement portions 35, 37, 39, 41 and 43 are extended back and forth as viewed in FIGS. 2 and 3, and the magnitude of extended length of these engagement portions 35, 37, 39, 41 and 43 becomes gradually smaller as the location of the corresponding pressing body becomes lower so as to be engaged with each of the sustaining portions 21*a* to 21*e* and 23*a* to 23*e*. Normally, these engagement portions 35, 37, 39, 41 and 43 are engaged with or rested on each of the sustaining portions 21*a* to 21*e* and 23*a* to 23*e* so as to sustain the pressing bodies 3, 5, 7, 9 and 11 while keeping them spaced apart from each other by a predetermined distance as shown in FIGS. 2 and 3.

A large number of grooves 3*a*, 5*a*, 7*a*, 9*a* and 11*a* each extending back and forth as viewed in FIGS. 2 and 3, 3 mm in width and 2 mm in depth are formed at an interval of 12 mm (in the running direction of the metal endless belts 95, 97, 99, 101 and 103, or in the direction of from left to right as viewed in FIGS. 2 and 3) on each of the bottom surface of the pressing body 3, the upper and bottom surfaces of the pressing bodies 5, 7 and 9 and the upper surface of the pressing body 11. By the way, the grooves 3*a*, 5*a*, 7*a*, 9*a* and 11*a* formed on each of the pressing bodies 3, 5, 7, 9 and 11 are formed in such a manner that the grooves facing to each other (e.g. 3*a* to 5*a*) are dislocated by a distance (in the running direction) of 6 mm.

Figure 5:
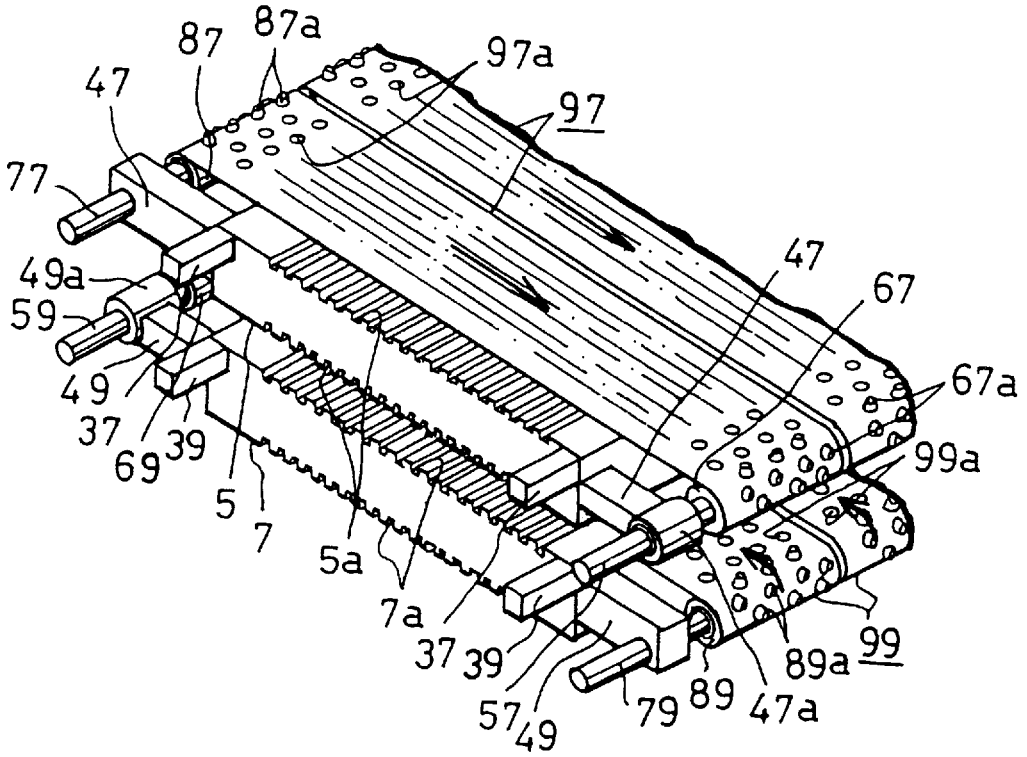
FIG. 5 is a perspective view of the pressing bodies of the second and third stages as counted from the top.

Each of the pressing bodies 3, 5, 7, 9 and 11 are provided at both sides thereof (or left and right sides in FIGS. 2 and 3) with arms 45, 47, 49, 51 and 53. Driving shafts 55, 57, 59, 61 and 63 are rotably mounted, via bearings 45*a*, 47*a*, 49*a*, 51*a* and 53*a*, on the right side of each of the arms 45, 47 and 51 disposed at the first, second and fourth stages and on the left side of each of the arms 49 and 53 disposed at the third and fifth stages, respectively as shown in FIG. 5. Each of these driving shafts 55, 57, 59, 61 and 63 are provided respectively with driving rolls 65, 67, 69, 71 and 73 which are fixed to these driving shafts by means of a known fixing mechanism such as a combination of key and key groove. Each of the driving rolls 65, 67, 69, 71 and 73 is formed of a partitioned structure wherein a plurality of rolls (not shown) each having the same axial length are successively mounted along the axial direction thereof. Each of the driving rolls 65, 67, 69, 71 and 73 is provided on its peripheral surface with a plurality of engaging protrusions 65*a*, 67*a*, 69*a*, 71*a* and 73*a*, each being formed of cone-shape having a height of about 6 mm. Each of these protrusions 65*a*, 67*a*, 69*a*, 71*a* and 73*a* is arranged in a staggered form, i.e. protrusions are spaced apart by an interval of 50 mm in the axial direction and by an interval of 25 mm in the direction perpendicular to the axial direction, and the neighboring arrays of protrusions running in the axial direction are dislocated by a distance of 25 mm from each other.

On the other hand, fixed shafts 75, 77, 79, 81 and 83 are mounted on the left side of each of the arms 45, 47 and 51 disposed at the first, second and fourth stages and on the right side of each of the arms 49 and 53 disposed at the third and fifth stages, respectively as shown in FIG. 5. Each of these fixed shafts 75, 77, 79, 81 and 83 is rotatably attached via a bearing with idler rolls 85, 87, 89, 91 and 93, respectively.

Each of the idler rolls 85, 87, 89, 91 and 93 is formed of a partitioned structure, as in the case of the aforementioned driving rolls, wherein a plurality of rolls (not shown) each having the same axial length are successively mounted along the axial direction thereof. Each of the idler rolls 85, 87, 89, 91 and 93 is provided on its peripheral surface with a plurality of engaging protrusions 85*a*, 87*a*, 89*a*, 91*a* and 93*a*, which are arranged in a staggered form as explained in the case of the engaging protrusions 65*a*, 67*a*, 69*a*, 71*a* and 73*a*.

Each of the driving rolls 65, 67, 69, 71 and 73 is linked with the corresponding one of the idler rolls 85, 87, 89, 91 and 93 by one of the endless metal belt 95, 97, 99, 101 and 103 which are wound around each pair of these driving rolls and idler rolls. Each of endless metal belt 95, 97, 99, 101 and 103 is formed of an anti-corrosive metallic (e.g. stainless steel) thin elongated plate (preferably about 0.5 mm in thickness) whose both ends are bonded together by making use of a heat resistant adhesive tape thereby to form an endless belt (when an adhesive tape is employed for bonding the both ends of metallic belt, the exchange of these endless metal belt 95, 97, 99, 101 and 103 can be easily performed, since this bonded portion can be easily separated). Each of these endless metal belt 95, 97, 99, 101 and 103 is provided with a large number of engaging holes 97*a* and 99*a*, each having a diameter of 12 mm. These engaging holes 97*a* and 99*a* are formed in a pattern which corresponds with that of the aforementioned engaging protrusions 65*a*, 67*a*, 69*a*, 71*a*, 73*a*, 85*a*, 87*a*, 89*a*, 91*a* and 93*a* and adapted to be engaged with these engaging protrusions 65*a*, 67*a*, 69*a*, 71*a*, 73*a*, 85*a*, 87*a*, 89*a*, 91*a* and 93*a*.

Furthermore, a servo-motor (not shown) is mounted on each of the driving shafts 55, 57, 59, 61 and 63, so that the rotation of driving shafts 55, 59 and 63 in counter-clockwise direction as viewed in FIGS. 2 and 3, or the rotation of driving shafts 57 and 61 in clockwise direction as viewed in FIGS. 2 and 3 can be concurrently effected at a constant peripheral speed or the rotation of these driving shafts can be suspended through the control of the servo-motor to be effected based on a control signal from a controlling means to be explained hereinafter. When the endless metal belt 95, 97, 99, 101 and 103 are actuated to move in the respective direction as indicated by arrows in FIGS. 2 and 3, a forward transfer passage for transferring a veneer from the first transfer device 4 to the second transfer device 6 is formed between the bottom surface of the metal belt 95 and the upper surface of the metal belt 97, and between the bottom surface of the metal belt 99 and the upper surface of the metal belt 101, while backward transfer passage for transferring a veneer from the second transfer device 6 to the first transfer device 4 is formed between the bottom surface of the metal belt 97 and the upper surface of the metal belt 99, and between the bottom surface of the metal belt 101 and the upper surface of the metal belt 103.

The aforementioned compression member 17 is designed to successively push up the pressing bodies 3, 5, 7, 9 and 11 from the non-pressing position where the sustaining portions 21*a* to 21*e* and 23*a* to 23*e* are rested respectively on the engagement portions 35, 37, 39, 41 and 43 to the pressing position, and then to press undried veneers 13*a*, 13*b*, 14*a* and 14*b* disposed between each pair of the pressing bodies 3, 5, 7, 9 and 11 at a pressure of about 2 kg/cm$^2$. The main frame 15 of the multistage pressing apparatus 2 is provided with a lower position detector 105 for detecting the position of the movable plate 19 connected to the compression member 17 when the movable plate 19 is descended down as shown in FIGS. 2 and 3, and with a stopper (not shown) for limiting the downward movement of the movable plate 19.

The first transfer device 4 and the second transfer device 6 which are arranged as shown in FIG. 1 on both sides of this multistage pressing apparatus 2 are constructed as explained below.

Namely, the first transfer device 4 comprises a frame 107 (indicated in FIGS. 2 and 3 by a dot and dash line), a pair of upper conveyer 111 and lower conveyer 113 which are disposed at the upper and lower portions of the frame 107 respectively so as to keep a space therebetween which is equivalent to three stages of the pressing bodies 3, 5, 7, 9 and 11, and a lifting member 119 such as hydraulic cylinder attached to the frame 107, which is adapted to move the frame 107 up and down so as to take an upper position where the level of the upper conveyer 111 conforms with the level of the pressing body 5 of the second stage from the top or to take a lower position where the level of the upper conveyer 111 conforms with the level of the pressing body 9 of the third stage from the top. Likewise, the second transfer device 6 comprises a frame 109 (indicated in FIGS. 2 and 3 by a dot and dash line), a pair of upper conveyer 115 and lower conveyer 117, and a lifting member 121. The specific structures and functions of these constituent members are the same as explained with reference to the first transfer device 4. By the way, detectors (such as a limit switch) 123*a*, 123*b*, 125*a* and 125*b* are disposed at the aforementioned upper position and lower position of the first transfer device 4 and the second transfer device 6, so that when any of the frames 107 and 109 are contacted with any of these detectors 123*a*, 123*b*, 125*a* and 125*b*, a signal is emitted, and, based on this emitted signal, a control means is actuated to drive or suspend the lifting members 119 and 121 so as to render the first transfer device 4 and the second transfer device 6 to take the aforementioned upper position or lower position. At the same time the positioning of the first transfer device 4 and the second transfer device 6 can be confirmed by these detectors.

Each of the upper conveyers 111 and 115 and the lower conveyers 113 and 117 is connected with a servo-motor (not shown), which can be controlled on the basis of a driving signal from the control means as explained hereinafter so as to allow the upper conveyers 111 and 115 and the lower conveyers 113 and 117 to be moved in the direction indicated by the arrows shown in FIGS. 2 and 3 at the same speed as that of the metal belts 95, 97, 99, 101 and 103 or to be suspended. Furthermore, each of the upper conveyers 111 and 115 and the lower conveyers 113 and 117 is provided with a veneer detector 127*a*, 127*b*, 129*a* or 129*b*, and, based on the detected signal from these veneer detectors 127*a*, 127*b*, 129*a* or 129*b*, a control means is actuated so as to allow or suspend the movement the upper conveyers 111 and 115 and the lower conveyers 113 and 117. At the same time the presence or absence of a veneer and the passage of the veneer can be confirmed by these detectors.

Next, the operation of the multistage pressing apparatus which is constructed as explained above will be further explained.

First of all, the initial conditions of the first transfer device 4 and the second transfer device 6 will be explained. The first transfer device 4 and the second transfer device 6 are moved to the upper position by the operation of the lifting members 119 and 121. At this moment, the positioning of the first transfer device 4 and the second transfer device 6 at the upper position is detected by the detectors 123*a* and 125*a*.

The multistage pressing apparatus 2 is conditioned such that the movable plate 19 is moved to the lower position by the returning movement of the compression member 17 thereby allowing the engagement portions 35, 37, 39, 41 and 43 to be rested on the sustaining portions 21*a* to 21*e* and 23*a* to 23*e*, so that the pressing bodies 3, 5, 7, 9 and 11 are spaced apart from each other by a predetermined distance. At this moment, the positioning of the movable plate 19 at the lower position is detected by the lower position detector 105.

Figure 6:
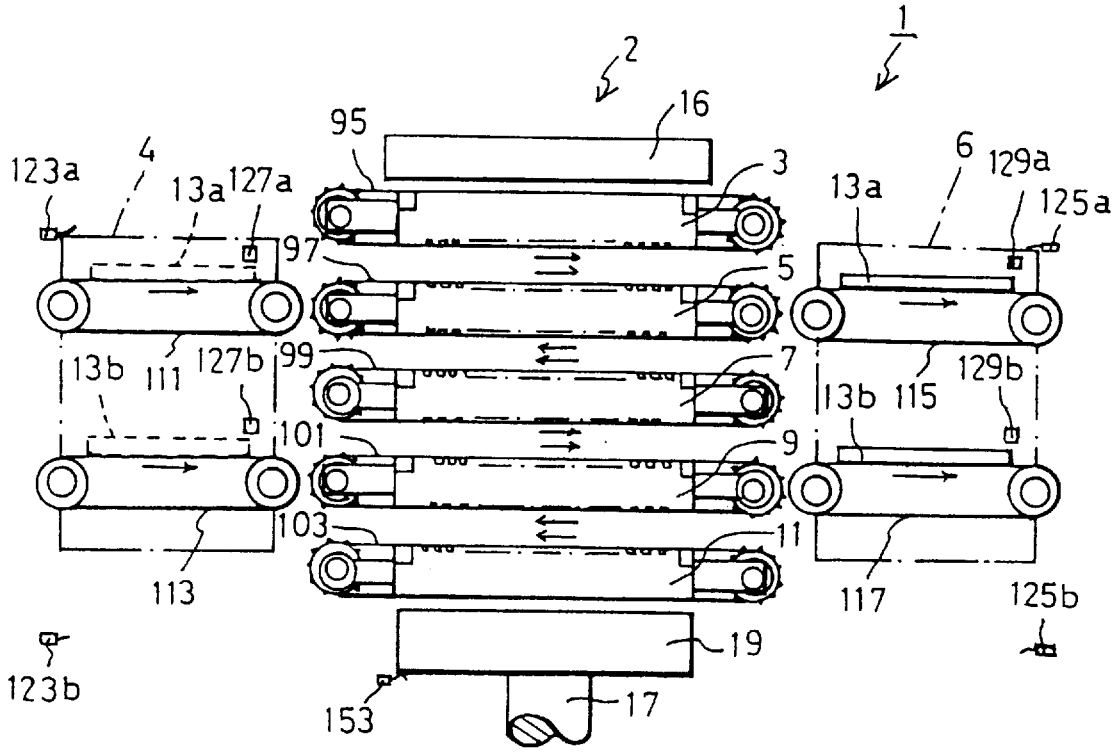
FIG. 6 is a front view of the veneer-pressing apparatus to illustrate the movement thereof.

Next, the upper conveyer 111 and the lower conveyer 113 of the first transfer device 4 are allowed to move in the rightward direction as shown in FIG. 6, and, under this condition, the veneers 13*a* and 13*b* each having a thickness of 3 mm for instance are placed on the upper conveyer 111 and the lower conveyer 113 respectively so as to transfer them. When the veneers 13*a* and 13*b* are transferred by the upper conveyer 111 and the lower conveyer 113 in this manner, the edges of the veneers 13*a* and 13*b* on the downstream side are detected respectively by the 4 veneer detectors 127*a* and 127*b*. Under the conditions that the downward movement of the movable plate 19 is detected by the lower position detector 105 and the positioning of the first transfer device 4 and the second transfer device 6 at the upper position is detected by the detectors 123*a* and 125*a*, the control means is actuated to render each of the metal belts 95, 97, 99, 101 and 103 to move in the direction as indicated by arrows shown in FIG. 6 and at the same time to render the upper conveyer 115 and the lower conveyer 117 of the second transfer device 6 to move in the rightward direction as indicated by the arrows shown in FIG. 6.

Figure 7:
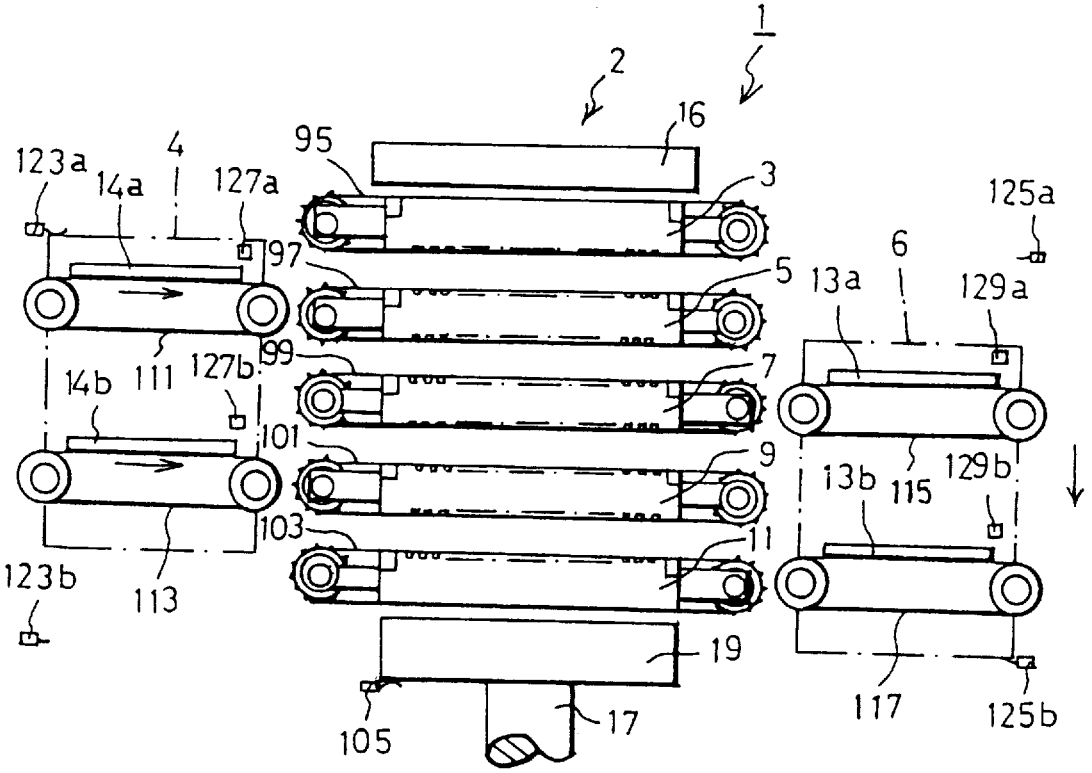
FIG. 7 is a front view of the veneer-pressing apparatus to illustrate the movement thereof.

The veneers 13*a* and 13*b* carried on the upper conveyer 111 and the lower conveyer 113 of the first transfer device 4 are then transferred to the metal belts 97 and 101 respectively, from which the veneers 13*a* and 13*b* are further transferred to the upper conveyer 115 and the lower conveyer 117 of the second transfer device 6. When the veneer 13*a* thus transferred is detected by the veneer detector 129*a*, the movement of upper conveyer 115 is suspended by the control means. Likewise, when the veneer 13*b* thus transferred is detected by the veneer detector 129*b*, the movement of lower conveyer 117 is suspended by the control means. At the same time, when a detection signal is transmitted from both veneer detectors 129*a* and 129*b* to the control means, the movement of all of the upper conveyer 111, the lower conveyer 113 and each of the metal belts 95, 97, 99, 101 and 103 is suspended. After the lapse of predetermined minimum period of time, the second transfer device 6 is lowered to the lower position as shown in FIG. 7, and at the same time only the upper conveyer 111 and the lower conveyer 113 are allowed to move to the rightward direction in FIG. 7. By the way, when the descending movement of the second transfer device 6 is detected by the detector 125*b*, the control means is actuated to suspend the movement of the second transfer device 6 and to render the second transfer device 6 to take a stand-by position at the lower position.

Under this condition, undried veneers 14*a* and 14*b* are loaded respectively on the upper conveyer 111 and the lower conveyer 113 which are running in the rightward direction in FIG. 7, and when the edges of these veneers 14*a* and 14*b* which are located at the downstream side in the transferring direction are detected respectively by the veneer detectors 127*a* and 127*b*, the control means is actuated to suspend the movement of the upper conveyer 111 and the lower conveyer 113.

Figure 8:
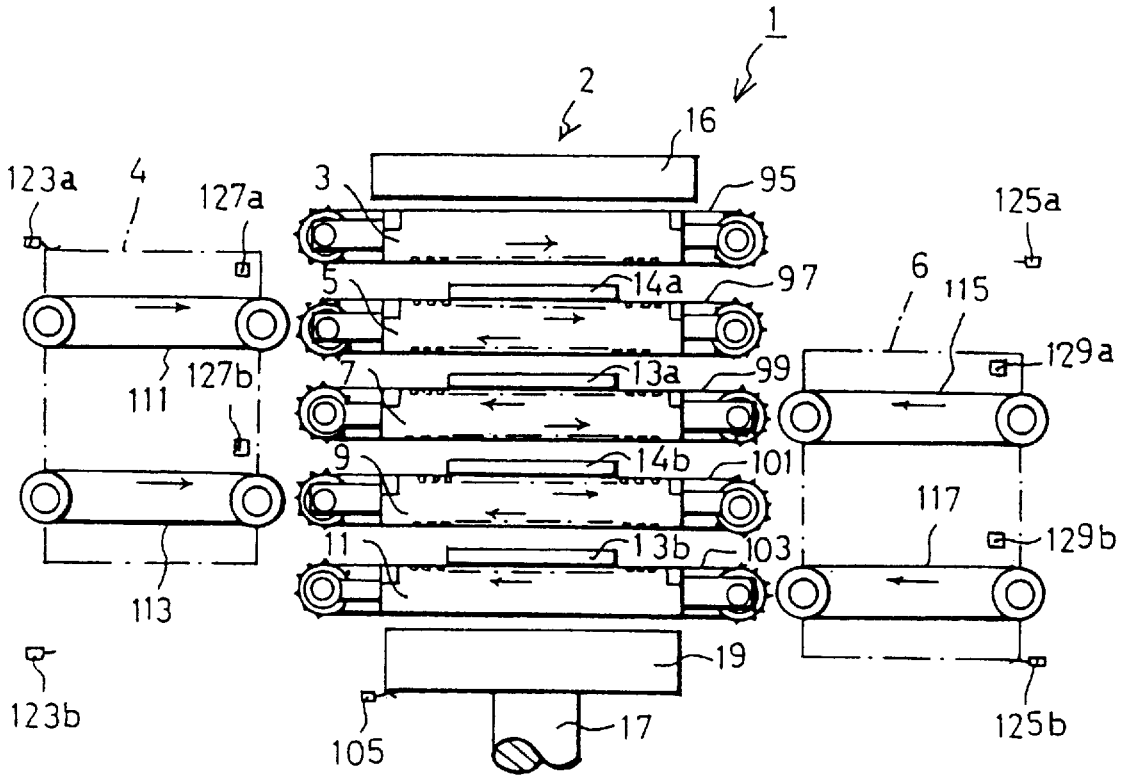
FIG. 8 is a front view of the veneer-pressing apparatus to illustrate the movement thereof.

After the lapse of predetermined minimum period of time, signals are emitted from the control means so as to allow the upper conveyer 111, the lower conveyer 113 and the metal belts 95, 97, 99, 101 and 103 to move in the same direction as indicated by the arrows in FIG. 8 and to allow the upper conveyer 115 and the lower conveyer 117 to move in the opposite direction (as indicated by the arrows in FIG. 8, i.e. toward the left side). These signals are set to continue until the veneers 14*a* and 14*b* on each of the upper conveyer 111 and the lower conveyer 113 and the veneers 13*a* and 13*b* on each of the upper conveyer 115 and the lower conveyer 117 are shifted a predetermined distance, i.e. until the veneers 13*a*, 13*b*, 14*a* and 14*b* carried respectively on by the corresponding metal belt 95, 97, 99, 101 or 103 each running in a predetermined direction are transferred over the central portion of each of the pressing bodies 5, 7, 9 and 11. In other words, when the veneers 13*a*, 13*b*, 14*a* and 14*b* are moved a predetermined distance or transferred to the aforementioned predetermined location, the output of signals form the control means is suspended, whereby suspending the movement of each of the upper conveyers 111 and 115, the lower conveyers 113 and 117, and the metal belts 95, 97, 99, 101 and 103. As a result, the veneers 13*a*, 13*b*, 14*a* and 14*b* carried respectively on the metal belts 95, 97, 99, 101 and 103 are transferred over the center of each of the pressing bodies 5, 7, 9 and 11. As for the means for moving the lower conveyers 113 and 117, and the metal belts 95, 97, 99, 101 and 103 a predetermined distance, a pulse oscillator which is capable of emitting the number of pulse in proportion to the running distance of the belt may be used wherein the number of pulse emitted from the pulse oscillator is measured by means of a counter installed in the control means and when the number of count measured by the counter becomes identical with the number of pulse which corresponds to the aforementioned predetermined distance, the output of signal for continuing the movement is suspended.

Figure 9:
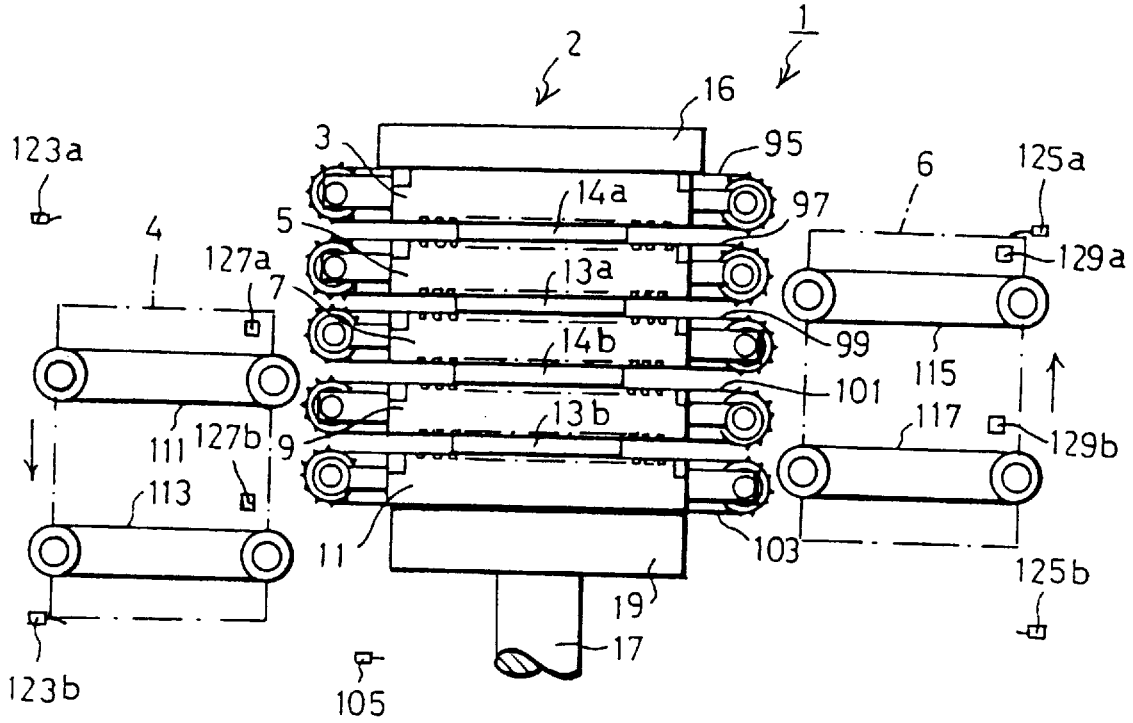
FIG. 9 is a front view of the veneer-pressing apparatus to illustrate the movement thereof.

When the number of count measured by the counter becomes identical with the number of pulse which corresponds to the aforementioned predetermined distance, another signal for actuating the compression member 17 is emitted from the control means to move the movable plate 19 upward as shown in FIG. 9, whereby pushing up at first the pressing body 11 located at the lowest stage and then successively pushing up the remaining pressing bodies 9, 7, 5 and 3 in the mentioned order. When the pressure by the compression member 17 reaches to a predetermined magnitude, the movement of the compression member 17 is suspended and the veneers 13*a*, 13*b*, 14*a* and 14*b* are pressed for a predetermined period of time by the pressing bodies 3, 5, 7, 9 and 11. During this pressing treatment, the veneers 13*a*, 13*b*, 14*a* and 14*b* interposed between any pair of the pressing bodies 3, 5, 7, 9 and 11 are heated by the heat from the pressing bodies 3, 5, 7, 9 and 11, thus evaporating the water contained in the veneers 13*a*, 13*b*, 14*a* and 14*b*. In this case, since the engaging holes 97*a* and 99*a* formed in the endless metal belt 95, 97, 99, 101 and 103 are distributed in the specific manner in relative to the grooves 3*a*, 5*a*, 7*a*, 9*a* and 11*a* as mentioned above, the engaging holes 97*a* and 99*a* of the endless metal belt 95, 97, 99, 101 and 103 are brought to face to the grooves 3*a*, 5*a*, 7*a*, 9*a* and 11*a* even if the stopping position of the metal belt 95, 97, 99, 101 and 103 differs from time to time. Accordingly, the water evaporated from the veneers 13*a*, 13*b*, 14*a* and 14*b* can be effectively discharged to the outer atmosphere through these engaging holes 97*a* and 99*a* and grooves 3*a*, 5*a*, 7*a*, 9*a* and 11*a*.

If the thickness of the veneers 13*a*, 13*b*, 14*a* and 14*b* is assumed to be about 3 mm, the pressing time of about 5 to 10 minutes may be sufficient for drying these veneers to reduce the water content thereof to about 0 to 15%. However, if the pressing of the veneers 13*a*, 13*b*, 14*a* and 14*b* is continued for a long period of time, the veneers 13*a*, 13*b*, 14*a* and 14*b* may be cracked due to the shrinkage by drying of the veneers. In order to avoid the generation of the cracking of veneer, this pressing operation may be intermittently performed. Namely, after the pressing of the veneers 13*a*, 13*b*, 14*a* and 14*b* is performed for one minute for instance, the compression member 17 may be moved downward thereby returning the movable plate 19 to the original position, thus releasing these veneers from pressing treatment for 20 seconds for instance, and then the compression member 17 is actuated again to press these veneers, thereafter the same processes being repeated required number of times. When the pressing of the veneers 13*a*, 13*b*, 14*a* and 14*b* is intermittently released in this manner in the process of drying the veneers, the veneers can be suitably shrunken while inhibiting the generation of cracking of veneer.

When the movable plate 19 is lifted making the lower position detector 105 impossible to detect the position of the movable plate 19, the control means is actuated in such a manner that the lifting member 119 is allowed to return thereby moving the first transfer device 4 to the lower position to take a stand-by position where the position of the first transfer device 4 can be detected by the lower detector 123*b* and that the lifting member 121 is actuated to move the second transfer device 6 to the upper position to take a stand-by position where the position of the second transfer device 6 can be detected by the upper detector 123*a*.

Then, after the lapse of predetermined pressing time, the compression member 17 is lowered to move the movable plate 19 downward according to the control means, and when the movable plate 19 is detected by the lower position detector 105, the returning movement of the compression member 17 is suspended. Accordingly, the pressing bodies 3, 5, 7, 9 and 11 are sustained in an expanded state where the engagement portions 35, 37, 39, 41 and 43 thereof are rested on the sustaining portions 21*a* to 21*e* and 23*a* to 23*e*, and the pressing bodies 3, 5, 7, 9 and 11 are spaced apart from each other by a predetermined distance as shown in FIG. 10.

Figure 10:
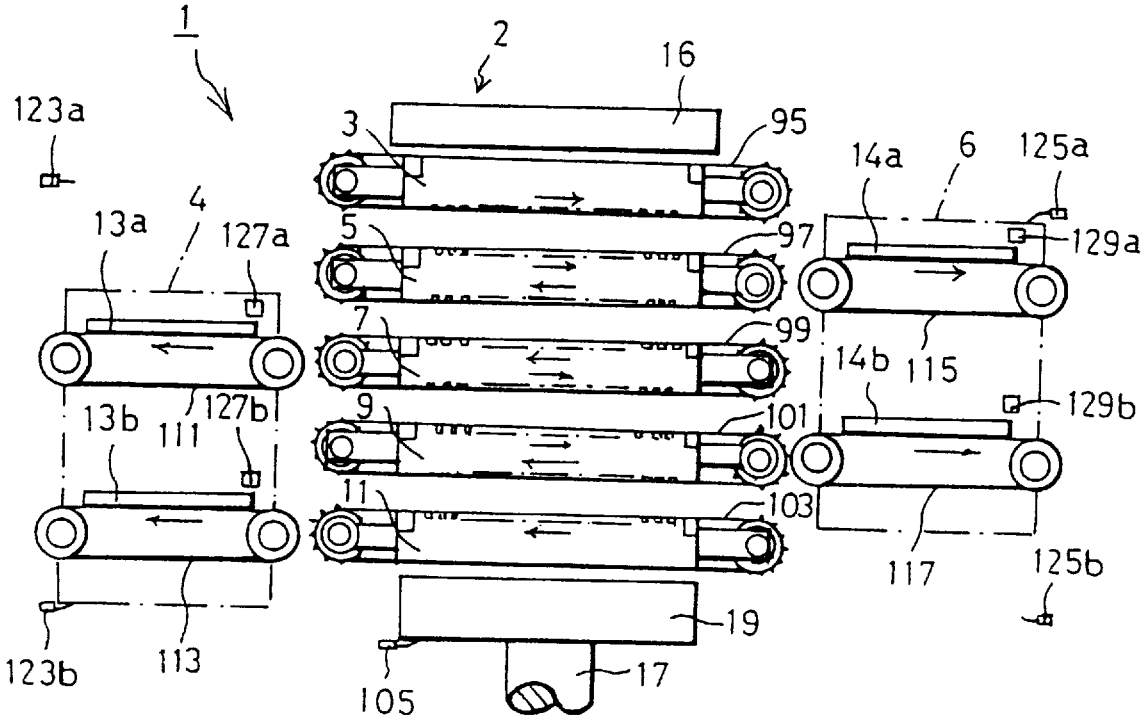
FIG. 10 is a front view of the veneer-pressing apparatus to illustrate the movement thereof.

Then, based on the detection signals from the lower position detector 105, the control means is actuated such that the endless metal belt 95, 97, 99, 101 and 103 are moved in the direction indicated by the arrows shown in FIG. 10, that the upper conveyer 111 and the lower conveyer 113 of the first transfer device 4 taking a stand-by position at the lower position are moved in the leftward direction in FIG. 10, and that the upper conveyer 115 and the lower conveyer 117 of the second transfer device 6 taking a stand-by position at the upper position are moved in the rightward direction in FIG. 10. As a result, the veneer 14*a* on the metal belt 97 is transferred onto the upper conveyer 115, the veneer 13*a* on the metal belt 99 is transferred onto the upper conveyer 111, the veneer 14*b* on the metal belt 101 is transferred onto the lower conveyer 117, and the veneer 13*b* on the metal belt 103 is transferred onto the lower conveyer 113, thus discharging these veneers out of the veneer-pressing apparatus.

In this occasion of transferring each of the veneers 13*a*, 13*b*, 14*a* and 14*b* through the movement of metal belt 95, 97, 99, 101 and 103 to the corresponding one of the upper conveyers 111 and 115 and the lower conveyers 113 and 117, not only the forward transfer passages are formed between the metal belts 97 and 95 and between the metal belts 101 and 99, but also the backward transfer passages are formed between the metal belts 99 and 97 and between the metal belts 103 and 101, the upper and bottom belt surfaces forming any of these passage being running in the same direction with each other. Therefore, even if the edge portions of the veneers 13*a*, 13*b*, 14*a* and 14*b* which are curved or bent due to drying or shrinkage are contacted with the bottom surfaces of the metal belts 95, 97, 99, 101 and 103 which are disposed over these veneers during the transfer thereof, there is no possibility that the transferring of these veneers would be hindered or these veneers 13*a*, 13*b*, 14*a* and 14*b* would be fractured during the transfer thereof.

With regard to the method of discharging these veneers 13*a*, 13*b*, 14*a* and 14*b* out of the veneer-pressing apparatus, it is possible to employ a discharge conveyer (not shown) which is normally driven for the transfer of veneer and adapted to be connected with each of the upper conveyer 111 and the lower conveyer 113 of the first transfer device 4 moved to the lower position and with the upper conveyer 115 and the lower conveyer 117 of the second transfer device 6 moved to the upper position as shown in FIG. 10. In this case, the veneers 13*a*, 13*b*, 14*a* and 14*b*, which are carried through the movements of the upper conveyers 111 and 115, of the lower conveyers 113 and 117, and of the metal belt 95, 97, 99, 101 and 103, are directly transferred onto the discharge conveyers respectively. The control means in this case is actuated such that the metal belt 95, 97, 99, 101 and 103, the upper conveyers 111 and 115, and the lower conveyers 113 and 117 are controlled to continue the movement thereof even if detection signals are output from the veneer detectors 127*a*, 127*b*, 129*a* and 129*b* when the veneers 13*a*, 13*b*, 14*a* and 14*b* are transferred respectively from the metal belt 95, 97, 99, 101 and 103 to the corresponding one of the upper conveyers 111 and 115 and the lower conveyers 113 and 117.

Figure 11:
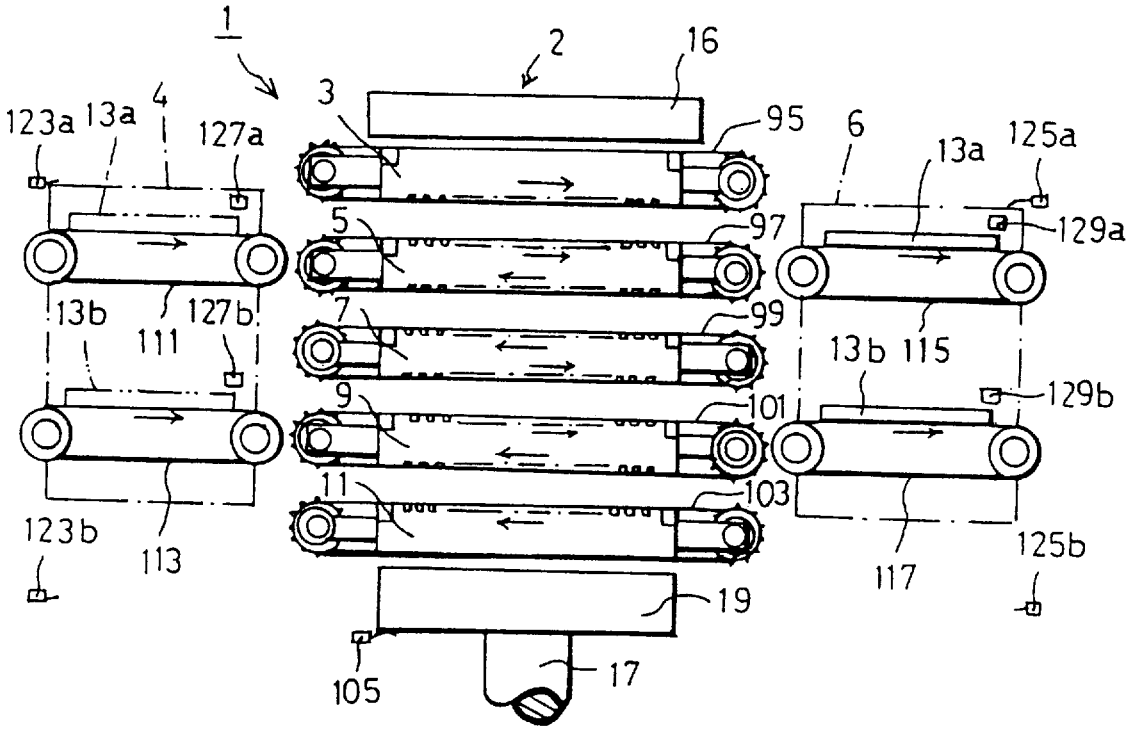
FIG. 11 is a front view of the veneer-pressing apparatus to illustrate the movement thereof.

In another embodiment of the method of discharging these veneers, a discharge conveyer (not shown) is disposed on the right side of each of the upper conveyer 115 and the lower conveyer 117 of the second transfer device 6 moved to the upper position so as to be connected with these conveyers 115 and 117 as shown in FIG. 11. In this case, the veneers 13*a*, 13*b*, 14*a* and 14*b*, which are carried through the movements of the metal belt 95, 97, 99, 101 and 103, of the upper conveyers 111 and 115, and of the lower conveyers 113 and 117, are transferred respectively onto the corresponding one of the upper conveyers 111 and 115 and the lower conveyers 113 and 117. The control means in this case is actuated such that the movement of the upper conveyer 115 and the lower conveyer 117 are continued so as to directly transfer the veneers 13*a*, 13*b*, 14*a* and 14*b* onto the discharge conveyer thereby discharging these veneers. On the other hand, when the veneers 13*a* and 13*b* carried on the upper conveyer 111 and the lower conveyer 113 are detected by the veneer detectors 127*a* and 127*b*, the movement of the upper conveyer 111 and the lower conveyer 113 are suspended to take a stand-by state. Under this condition, the first transfer device 4 is lifted up to a position where it is detected by the detector 123*a* and stopped to take a stand-by state, and then the upper conveyer 111 and the lower conveyer 113 are allowed to move in the direction indicated by the arrows shown in FIG. 11, whereby transferring the veneers 13*a* and 13*b* via the moving metal belt 95, 97, 99, 101 and 103 onto the upper conveyer 115 and the lower conveyer 117, the veneers 13*a* and 13*b* being subsequently transferred on the discharge conveyer so as to be discharged.

In this discharging embodiment, a discharge conveyer (not shown) may be disposed on the left side of each of the upper conveyer 111 and the lower conveyer 113 of the first transfer device 4 moved to the lower position so as to be connected with these conveyers 111 and 113 as shown in FIG. 10. In this case, the veneers 13*a* and 13*b* are allowed to be directly discharged by means of the upper conveyer 111 and the lower conveyer 113. Then, the second transfer device 6 is moved to the lower position, and then the upper conveyers 115 and the lower conveyer 117 are allowed to move in a direction opposite to the arrows shown in FIG. 10, whereby transferring and discharging the veneers 14*a* and 14*b* via the moving upper and lower conveyers 111 and 113 in the same manner as in the case of the veneers 13*a* and 13*b*.

According to this embodiment, the veneers 13*a*, 13*b*, 14*a* and 14*b* which are interposed in the spaces between each pair of the pressing bodies 3, 5, 7, 9 and 11 are transferred by the metal belts 95, 97, 99, 101 and 103 which are adapted be moved in the same direction on both upper and bottom surfaces of these veneers. Therefore, even if the edge portions of the veneers 13*a*, 13*b*, 14*a* and 14*b* which are curved or bent are contacted with the bottom surfaces of the metal belts 95, 97, 99, 101 and 103 which are disposed over these veneers during the transfer thereof, there is no possibility that the transferring of these veneers would be hindered. Moreover, since the first transfer device 4 and the second transfer device 6 are designed such that each device is provided with only the upper conveyer (111 and 115) and the lower conveyer (113 and 117), which are less in number as compared with the number of the pressing bodies 3, 5, 7, 9 and 11, and that the running direction and vertical position of each device can be suitably controlled, it is possible to load or unload a larger number of veneers 13*a*, 13*b*, 14*a* and 14*b* than the number of conveyer in the first transfer device 4 and the second transfer device 6, thus making it possible to minimize the size of the veneer-pressing apparatus 1.

In the above explanation, the passages between the pressing bodies 3 and 5, and between the pressing bodies 7 and 9 are defined as being a forward transfer passage, while the passages between the pressing bodies 5 and 7, and between the pressing bodies 9 and 11 are defined as being a backward transfer passage. However, this is only a matter of nomenclature, so that the passages between the pressing bodies 5 and 7, and between the pressing bodies 9 and 11 may be defined as being a forward transfer passage in FIG. 1, and the first and second veneers may be supplied from the right side of the multistage pressing apparatus 2.

Moreover, the first transfer device 4 is descended while the second transfer device 6 is ascended upon receipt of a signal for moving the movable plate 19 upward for the purpose of drying the veneers in FIG. 9. However, these descending and ascending movements may be retarded until the moment when the movable plate 19 is lowered down to the non-pressing position as shown in FIG. 10 after finishing the drying of the veneers so that the metal belts 95, 97, 99, 101 and 103 are ready for moving.

Explanation on the Modified Embodiment

1. In th above embodiment, five stages of pressing bodies 3, 5, 7, 9 and 11 are employed for the multistage pressing apparatus 2, and two stages of the upper conveyers 111 and 115 and the lower conveyers 113 and 117 are employed for each of the first and second transfer devices 4 and 6 for simultaneously pressing four sheets of the veneers 13*a*, 13*b*, 14*a* and 14*b*. However, it is also possible according to this invention to employ three stages of pressing bodies for the multistage pressing apparatus and a single stage of conveyer for each of the first and second transfer apparatus, wherein the metal belt of the pressing body is allowed to intermittently move always in a fixed direction, while the first and second transfer devices are allowed to move up and down with the running direction thereof being made changeable, whereby making it possible to simultaneously perform the pressing treatment of a couple of veneers.

2. In the above embodiment, five stages (i.e. odd number of stage) of pressing bodies are employed for the multistage pressing apparatus 2, and two stages of the upper conveyers 111 and 115 and the lower conveyers 113 and 117 are employed for each of the first and second transfer devices 4 and 6 for simultaneously pressing four sheets of the veneers 13*a*, 13*b*, 14*a* and 14*b*. However, an additional pressing body may be mounted in same manner as explained above at the uppermost portion or the lowermost portion of the multistage pressing apparatus 2 thereby making the number of entire pressing bodies into an even number, wherein the pressing bodies at the odd stage are controlled in the same manner as explained above, while the other pressing bodies at the even stage are controlled as explained below.

Figure 12:
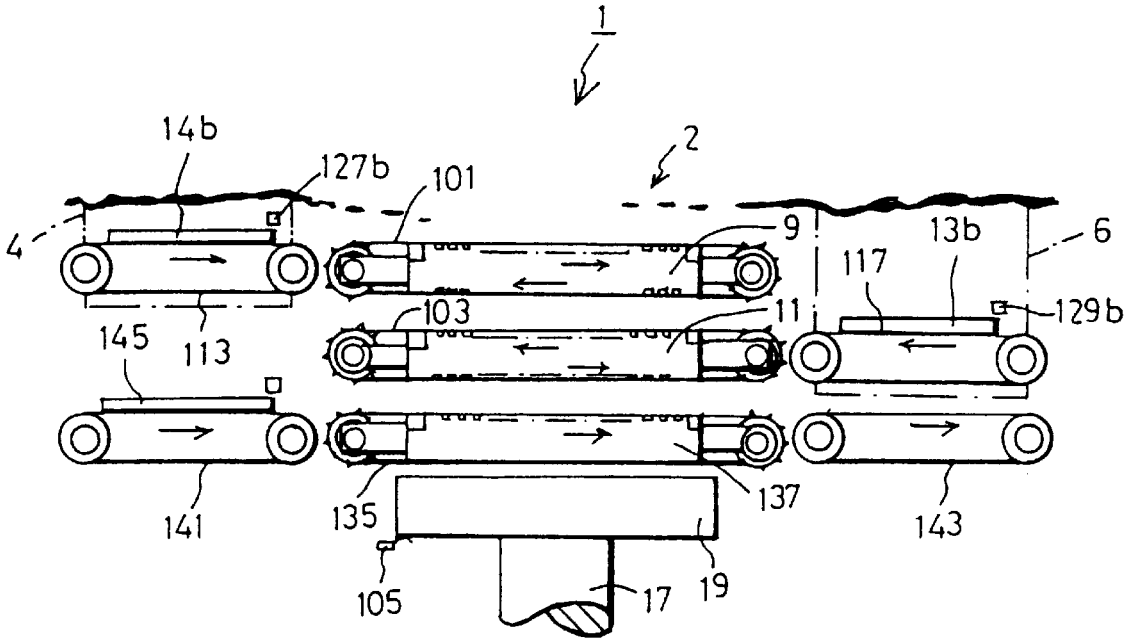
FIG. 12 is a front view of the veneer-pressing apparatus according another embodiment of this invention.

Namely, as shown in FIG. 12, another pressing body 137 provided with a metal belt 135 in the same manner as in the pressing body 11 is disposed between the pressing body 11 positioned at the lowermost stage in FIG. 1 and the movable plate 19. In this case, the pressing body 137 is arranged such that it is spaced apart from the pressing body 11 by a predetermined distance and the engagement portion 139 thereof is rested on a sustaining portion (not shown). A couple of conveyers 141 and 143 are fixedly disposed on the right and left sides of the pressing body 137 and below the first transfer device 4 and the second transfer device 6, respectively as shown in FIG. 12, the upper surfaces of these conveyers 141 and 143 being made flush with the transferring surface of the metal belt 135. The metal belt 135 and conveyer 141 are controlled such that they can be intermittently moved only in the direction as indicated by the arrows shown in FIG. 12, while the conveyer 143 is controlled to be constantly moved. Further, a detector 147 is disposed near the conveyer 141 so as to detect the downstream side, in transferring direction, of a veneer 145. By the way, a discharge conveyer (not shown) is disposed at the downstream side, in transferring direction, of the conveyer 143. In the embodiment shown in FIG. 12, the pressing body 137 provided with the metal belt 135 and the conveyers 141 and 143 are arranged at the lowermost stage portion of the multistage pressing apparatus 2. However, the pressing body 137 provided with the metal belt 135 and the conveyers 141 and 143 may be arranged at the uppermost stage portion of the multistage pressing apparatus 2.

In this construction, the veneers 13*a* and 13*b* which have been loaded in advance are transferred onto the upper conveyer 115 and the lower conveyer 117 of the second transfer device 6, which is then lowered down to the lower position as shown in FIG. 7. Under this condition, only the upper conveyer 111, the lower conveyer 113 and the conveyer 141 are allowed to move in the direction as indicated by the arrows shown in FIG. 12, and then the next veneers 14*a*, 14*b* and 145 are loaded on the upper conveyer 111, the lower conveyer 113 and the conveyer 141 respectively. When the edge portions on downstream side of the veneers 14*a*, 14*b* and 145 are detected by the veneer detectors 127*a*, 127*b* and 147, the movement of the upper conveyer 111, the lower conveyer 113 and the conveyer 141 is suspended by way of the control means according to the detected signals, and after the lapse of predetermined period of time following the output of the detection signal from all of the veneer detectors 127*a*, 127*b* and 147, all of the upper conveyer 111, the lower conveyer 113, the conveyer 141 and metal belts 95, 97, 99, 101 and 103 are allowed to move in the directions as shown in FIG. 12, and at the same time, the upper conveyer 115 and the lower conveyer 117 of the second transfer device 6 are allowed to move in the leftward direction in FIG. 12, thereby transferring the veneers 13*a*, 13*b*, 14*a*, 14*b* and 145 to the central portion of each of the pressing bodies 3, 5, 7, 9, 11 and 137. At this moment, the movement of these metal belts is suspended.

Then, the compression member 17 is actuated according to the control means thereby to subjecting the veneers 13*a*, 13*b*, 14*a*, 14*b* and 145 disposed between any pair of the pressing bodies 3, 5, 7, 9, 11 and 137 to a pressing treatment for a predetermined period of time. Thereafter, the compression member 17 is allowed to descend, thus releasing the veneers 13*a*, 13*b*, 14*a*, 14*b* and 145 from this pressing. Under this condition, the upper conveyer 111 and the lower conveyer 113 of the first transfer device 4, the upper conveyer 115 and the lower conveyer 117 of the second transfer device 4, and metal belts 95, 97, 99, 101 and 103 are allowed to move in the same manner as mentioned above, thereby to take out the veneers 13*b*, 14*a*, 14*b* and 145 thus pressed. At the same time, the metal belt 135 is controlled to move in rightward direction as shown in FIG. 12, thereby taking out the veneer 145 via the conveyer 143 running constantly.

Figure 13:
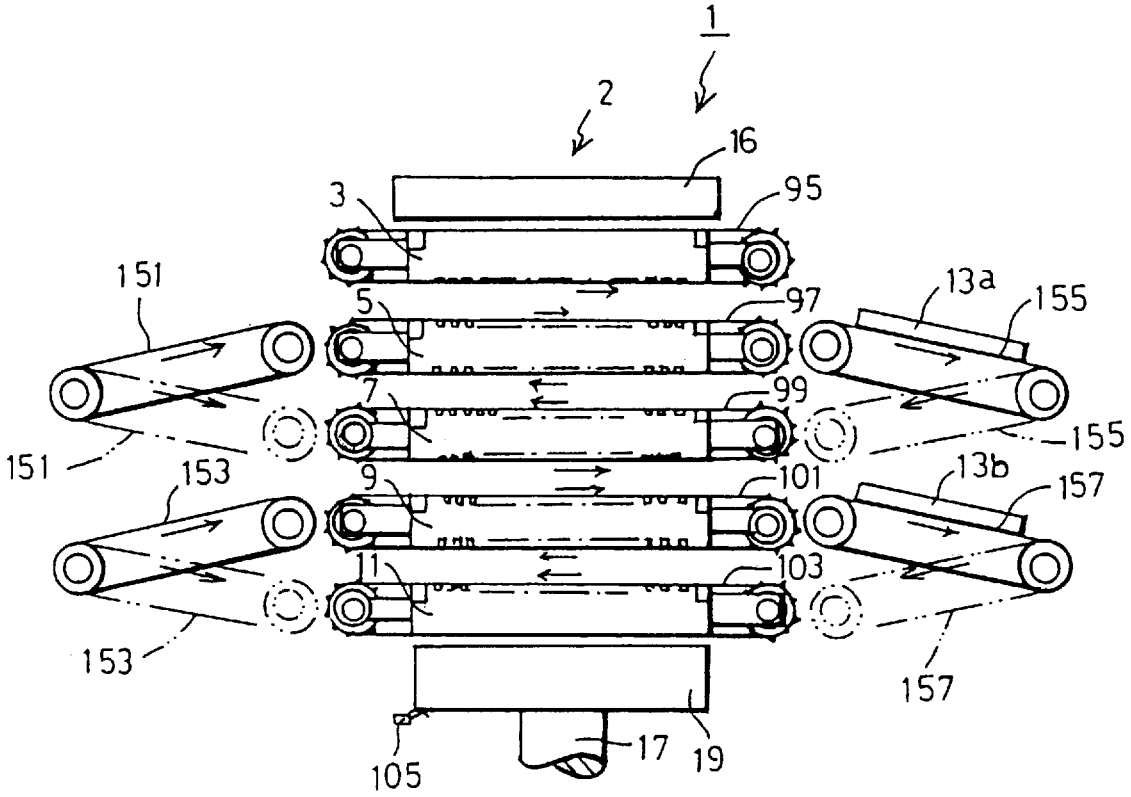
FIG. 13 is a front view of a veneer-pressing apparatus according another embodiment of this invention.
Figure 14:
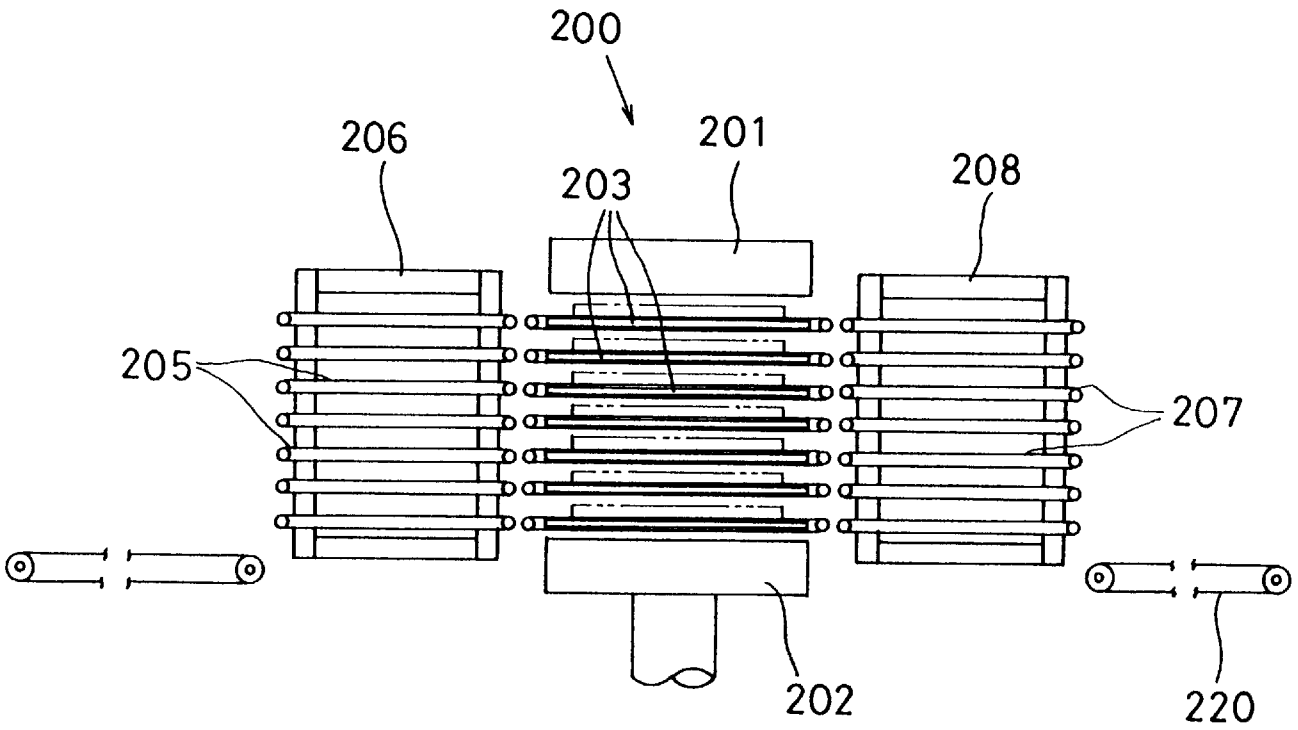
FIG. 14 is a front view schematically showing a veneer-pressing apparatus according to the prior art.
Figure 15:
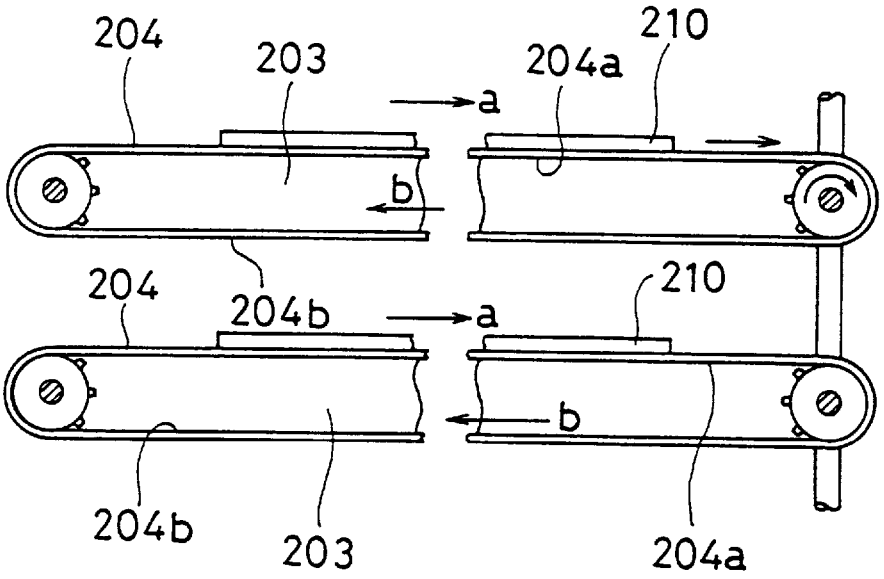
FIG. 15 is an enlarged view of a main portion of the conventional veneer-pressing apparatus.

3. In the above embodiment, the first and second transfer devices 4 and 6 are entirely moved up and down so as to conform with the upper conveyers 111 and 115 and the lower conveyers 113 and 117 with the levels of pressing bodies 5, 7, 9 and 11, respectively. However, the upper conveyers 151 and 155 and the lower conveyers 153 and 157 constituting the first transfer device 4 and the second transfer device 6 may be disposed in a manner as shown in FIG. 13, i.e. the proximal end portion of each conveyer is pivotally supported so that it is capable of rotating about its proximal end portion in an angle range which corresponds to the distance of one stage of the pressing bodies 5, 7, 9 and 11 as measured when the pressing bodies are rested in the non-pressing position. In this case, the free end portion of each of the upper conveyers 151 and 155 and the lower conveyers 153 and 157 is capable of selectively conforming with the corresponding one of the pressing bodies 5, 7, 9 and 11.

As for the location of pivotally supporting each of the upper conveyers 151 and 155 and the lower conveyers 153 and 157, the upper conveyers 151 and 155 may be located to correspond with the second pressing body 5, while the lower conveyers 153 and 157 may be located to correspond with the fourth pressing body 9. Alternatively, the upper conveyers 151 and 155 may be located at an intermediate portion between the second and third (as counted from the top) pressing bodies, while the lower conveyers 153 and 157 may be located at an intermediate portion between the fourth and fifth (as counted from the top) pressing bodies.

The movement, timing for stoppage and switching of running direction of these upper conveyers 151 and 155 and lower conveyers 153 and 157 may be performed as follows.

First of all, each of the upper conveyers 151 and 155 and the lower conveyers 153 and 157 is allowed to stand at the locations indicated by the solid line in FIG. 13. Then, in the same manner as explained with reference to FIG. 6, at first the veneers 13*a* and 13*b* are transferred onto the upper conveyer 155 and the lower conveyer 157 and allowed to stand. Then, the apparatus is actuated from the state shown in FIG. 6 to the state shown in FIG. 7, i.e. instead of lowering the second transfer device 6, the upper conveyer 155 and the lower conveyer 157 are rotated downward to the positions as indicated by a dot and dash line in FIG. 13. On the other hand, in the same manner as explained with reference to FIG. 7, the following veneers (not shown) are transferred onto the upper conveyer 151 and the lower conveyer 153 and allowed to stand at first, and then the upper conveyers 151 and 155 and the lower conveyers 153 and 157 are allowed to move with the same timing as explained above toward the multistage pressing apparatus 2, thereby feeding each of the veneers into each of the passages of the multistage pressing apparatus 2. Next, the movable plate 19 is moved upward by actuating the compression member 17, thus pressing each of the veneers as shown in FIG. 9. At this moment, instead of lowering the first transfer device 4, the upper conveyer 151 and the lower conveyer 153 are rotated downward to the positions as indicated by a dot and dash line in FIG. 13. On the other hand, the upper conveyer 155 and the lower conveyer 157 are rotated upward to the positions indicated by a solid line in FIG. 13 and kept standing as they are. After finishing of the pressing treatment for a predetermined period of time, the upper conveyers 151 and 155 and the lower conveyers 153 and 157 are moved away from the multistage pressing apparatus 2, and the following veneers are transferred onto the upper conveyer 155 and the lower conveyer 157 as in the case of FIG. 10, from which the veneers are transferred to the following step. On the other hand, the veneers 13*a* and 13*b* are kept stopped at the predetermined location on the upper conveyer 151 and the lower conveyer 153. Then, the upper conveyer 151 and the lower conveyer 153 are moved to the positions indicated by a solid line in FIG. 13 by rotating them, thus placing these conveyers in the same condition as shown in FIG. 11. Then, the upper conveyers 151 and 155 are moved toward the multistage pressing apparatus 2, while the lower conveyers 153 and 157 are moved away from the multistage pressing apparatus 2, whereby transferring the veneers 13*a* and 13*b* to the forward transfer passage and then to the following step via the upper conveyers 151 and 155 and the lower conveyers 153 and 157 as in the case of the aforementioned embodiment.

In this modified embodiment, a detector for detecting the veneers are integrally attached to each of the upper conveyers 151 and 155 and the lower conveyers 153 and 157, so that the detector is adapted to be moved up and down together with the rotational movement of upper conveyers 151 and 155 and the lower conveyers 153 and 157. Although not shown in FIG. 13, a limit switch for detecting the rotational downward and upward movements of the first transfer device 4 and the second transfer device 6 is installed in the same manner as in the case of the aforementioned embodiment.

4. When a veneer of coniferous tree type which is rich in resin is to be dried by making use of the aforementioned multistage pressing apparatus 2, the resin contained in the veneer is exuded out of the veneer and enters into a space between the pressing bodies 3, 5, 7, 9 and 11 and the metal belts 95, 97, 99, 101 and 103 thereby hindering the movement of the metal belts 95, 97, 99, 101 and 103. Moreover, the grooves 3*a*, 5*a*, 7*a*, 9*a* and 11*a* may be clogged with the resin, thereby preventing water vapor from being diffused into the outer atmosphere.

However, these problems can be avoided by applying water on the upper surface of the veneer to be dried and then by allowing the adhered water to be explosively evaporated at the occasion of pressing the veneer, thus blowing away the resin which has been adhered onto the pressing bodies 3, 5, 7, 9 and 11 or onto the metal belts 95, 97, 99, 101 and 103, or filled in the grooves 3*a*, 5*a*, 7*a*, 9*a* and 11*a*.

5. In the above embodiments, the first and second transfer devices 4 and 6 are designed to be moved up and down in relative to the multistage pressing apparatus 2. However, these first and second transfer devices 4 and 6 may be fixedly disposed, and, instead of these transfer devices, the multistage pressing apparatus 2 may be designed to be moved up and down to a distance corresponding to the interval of one stage of pressing bodies.

6. In the above embodiments, the upper conveyers 111 and 115 and the lower conveyers 113 and 117, which constitute the first and second transfer devices 4 and 6, are designed to simply carry veneers thereon. However, these conveyers may be of the type which are capable of vacuum-adsorbing the veneers.

7. In the above embodiments, a monolithic veneer is subjected to the pressing treatment. However, a laminate of veneers wherein each veneer is adhered via an adhesive to each other may be subjected to the pressing treatment.

8. In the above embodiments, the veneers are subjected to the drying treatment by making use of a heated pressing bodies 3, 5, 7, 9 and 11. However, the veneers may be subjected to a cold pressing by making use of a non-heated pressing bodies.

It is possible according to the present invention to provide a veneer-pressing apparatus which is capable of accurately transferring a plurality of veneers even if the edge portion of the veneer is curved or bent upward, and is capable of performing a simultaneous pressing treatment.

What is claimed is:

1. An apparatus for simultaneously pressing a plurality of veneers, which comprises;

a plurality of pressing bodies;

a pressing device perpendicularly supporting said plurality of pressing bodies in multistage wherein said pressing bodies are made movable from a non-pressing position where said pressing bodies are vertically spaced apart from each other by a predetermined interval to a pressing position where said pressing bodies are close to each other;

a first veneer transfer means disposed on one side of said pressing device and is capable of reversing a transferring direction; and a second veneer transfer means disposed on a side of said pressing device which is opposite to said one side and is capable of reversing a transferring direction;

wherein each of said pressing bodies is provided along the surface thereof with an endless belt which is capable of intermittently moving round the pressing body, thereby forming between neighboring pressing bodies placed one upon another veneer-transferring passages whose transferring direction changed alternately from forward direction to backward direction; and said veneers are adapted to be introduced simultaneously or separately into said veneer-transferring passages by way of said first veneer transfer means and said second veneer transfer means.

2. The apparatus for simultaneously pressing a plurality of veneers according to claim 1, wherein said first veneer transfer means is adapted to introduce a veneer in a veneer-transferring passage of forward direction, while said second veneer transfer means is adapted to introduce a veneer in a veneer-transferring passage of backward direction.

3. The apparatus for simultaneously pressing a plurality of veneers according to claim 1, wherein said first veneer transfer means and said second veneer transfer means are designed such that at least one edge portion of each which faces to said veneer-transferring passage is capable of perpendicularly changing the position thereof, so that said first veneer transfer means thus changed in position so as to face said veneer-transferring passage of forward direction is enabled to feed a veneer to said veneer-transferring passage of forward direction, thus allowing the veneer to be fed via said veneer-transferring passage of forward direction to said second veneer transfer means that has been changed in position so as to face said veneer-transferring passage of forward direction, while said second veneer transfer means thus received with the veneer is enabled to feed the veneer to said veneer-transferring passage of backward direction as said second veneer transfer means is brought to face said veneer-transferring passage of backward direction as a result of said change in position.

4. The apparatus for simultaneously pressing a plurality of veneers according to claim 3, wherein said first veneer transfer means facing said veneer-transferring passage of forward direction after being changed in position is enabled to feed a second veneer to said veneer-transferring passage of forward direction, in concurrent with the feeding of veneer to said veneer-transferring passage of backward direction by said second veneer transfer means.

5. The apparatus for simultaneously pressing a plurality of veneers according to claim 3 or 4, wherein said first veneer transfer means facing said veneer-transferring passage of backward direction after being changed in position is designed to receive a veneer that has been pressed and unloaded from said veneer-transferring passage of backward direction, while said second veneer transfer means facing said veneer-transferring passage of forward direction after being changed in position is designed to receive a veneer that has been pressed and unloaded from said veneer-transferring passage of forward direction.

6. The apparatus for simultaneously pressing a plurality of veneers according to claim 5, wherein said first veneer transfer means facing said veneer-transferring passage of backward direction after being changed in position and received a veneer that has been pressed and unloaded from said veneer-transferring passage of backward direction is further designed to feed said veneer to said veneer-transferring passage of forward direction after said first veneer transfer means is changed in position to face said veneer-transferring passage of forward direction, said pressed veneer that has been fed to said veneer-transferring passage of forward direction being designed to be received, through said veneer-transferring passage of forward direction, by said second veneer transfer means that has been changed in position to face said veneer-transferring passage of forward direction.

7. The apparatus for simultaneously pressing a plurality of veneers according to claim 5, wherein said second veneer transfer means facing said veneer-transferring passage of forward direction after being changed in position and received a veneer that has been pressed and unloaded from said veneer-transferring passage of forward direction is further designed to feed said veneer to said veneer-transferring passage of backward direction after said second veneer transfer means is changed in position to face said veneer-transferring passage of backward direction, said pressed veneer that has been fed to said veneer-transferring passage of backward direction being designed to be received, through said veneer-transferring passage of backward direction, by said first veneer transfer means that has been changed in position to face said veneer-transferring passage of backward direction.

8. A veneer-pressing apparatus which comprises;

(a) pressing device comprising;

at least three pressing bodies disposed parallel with each other and made movable from a non-pressing position where said pressing bodies are vertically spaced apart from each other by a predetermined interval to a pressing position where said pressing bodies are close to each other;

endless belts each adapted to be intermittently moved along the upper surface and bottom surface of each of said pressing bodies and in a direction which is opposite to that of the neighboring endless belt, thereby forming a forward transfer passage between a pair of facing surfaces of the neighboring endless belts and a backward transfer passage between a pair of facing surfaces of the neighboring endless belts which is opposite in transferring direction to said forward transfer passage; and a pressing member which is capable of rendering said at least three pressing bodies provided with-said endless belt to move from a non-pressing position where said pressing bodies are vertically spaced apart from each other by a predetermined interval so as to form said forward transfer passage and said backward transfer passage alternately between said pressing bodies to a pressing position where said pressing bodies are close to each other so as to press a veneer carried on each of said transfer passage with a predetermined pressure;

(b) a first transfer means disposed in conformity with and on an upstream side of said forward transfer passage in said pressing device, a transferring direction of said first transfer means being the same as that of said forward transfer passage;

(c) a second transfer means disposed on an upstream side of said backward transfer passage in said pressing device and capable of being intermittently moved in both forward and backward directions, said second transfer means being also capable of being moved in vertical direction; and (d) a control means constituted by a control system wherein when each of the pressing bodies is moved to the non-pressing position and when the second transfer means is positioned to conform with the forward passage, the first and second transfer means are allowed to move in the direction conforming to that of the forward passage, and at the same time each of the endless belts is allowed to move whereby transferring a first veneer placed in advance on the first transfer means to the forward transfer passage and then to the second transfer means; and then, the second transfer means carrying the first veneer is vertically move to conform with the backward transfer passage, and a second veneer is put in place on the first transfer means until the aforementioned vertical movement of the second transfer means carrying the first veneer to conform with the backward transfer passage is finished; and, under this condition, the first transfer means is allowed to move in the direction conforming to that of the forward transfer passage and the second transfer means is allowed to move in the direction conforming to that of the backward transfer passage, and at the same time, each of the endless belts is allowed to move whereby transferring the second veneer carried on the first transfer means to the forward transfer passage formed between the pressing bodies, while the first veneer carried on the second transfer means to the backward transfer passage formed between the pressing bodies; and then, the movement of at least the endless belts among the first and second transfer means and the endless belts is suspended, and under this condition, the pressing member is actuated to move the pressing bodies to the pressing position respectively, thereby performing the pressing of the first and second veneers.

9. A veneer-pressing apparatus which comprises;

(a) pressing device comprising;

at least three pressing bodies disposed parallel with each other and made movable from a non-pressing position where said pressing bodies are vertically spaced apart from each other by a predetermined interval to a pressing position where said pressing bodies are close to each other;

endless belts each adapted to be intermittently moved along the upper surface and bottom surface of each of said pressing bodies and in a direction which is opposite to that of the neighboring endless belt, thereby forming a forward transfer passage between a pair of facing surfaces of the neighboring endless belts ad a backward transfer passage between a pair of facing surfaces of the neighboring endless belts which is opposite in transferring direction to said forward transfer passage; and a pressing member which is capable of rendering said at least three pressing bodies provided with said endless belt to move from a non-pressing position where said pressing bodies are vertically spaced apart from each other by a predetermined interval so as to form said forward transfer passage and said backward transfer passage alternately between said pressing bodies to a pressing position where said pressing bodies are close to each other so as to press a veneer carried on each of said transfer passage with a predetermined pressure;

(b) a first transfer means disposed in conformity with and on an upstream side of said forward transfer passage in said pressing device and being capable of intermittently moving in a forward direction conforming with a transferring direction of said forward transfer passage and also in a direction opposite to said forward direction, said first transfer means being also capable of being moved in vertical direction so as to conform with said forward passage or said backward passage;

(c) a second transfer means disposed in conformity with and on a downstream side of said forward transfer passage in said pressing device and being capable of intermittently moving in said forward direction and in a direction opposite to said forward direction, said second transfer means being also capable of being moved in vertical direction so as to conform with said forward passage or said backward passage; and (d) a control means constituted by a control system wherein when each of the pressing bodies is moved to the non-pressing position and when the first and second transfer means are positioned to conform with the forward passage, the first and second transfer means are allowed to move in the forward direction, and at the same time each of the endless belts is allowed to move whereby transferring a first veneer placed in advance on the first transfer means to the forward transfer passage and then to the second transfer means; and then, the second transfer means carrying the first veneer is vertically move to conform with the backward transfer passage, and a second veneer is put in place on the first transfer means until the aforementioned vertical movement of the second transfer means carrying the first veneer to conform with the backward transfer passage is finished; and, under this condition, the first transfer means is allowed to move in the forward direction and the second transfer means is allowed to move in the backward direction, and at the same time, each of the endless belts is allowed to move whereby transferring the second veneer carried on the first transfer means to the forward transfer passage formed between the pressing bodies, while the first veneer carried on the second transfer means to the backward transfer passage formed between the pressing bodies; and then, the movement of the first and second transfer means and the endless belts is suspended, and under this condition, the pressing member is actuated to move the pressing bodies to the pressing position respectively, thereby performing the pressing of the first and second veneers for a predetermined period of time; and then a pressing action of said pressing member is released, whereby allowing each of said pressing bodies to move to said non-pressing position and releasing said first and second veneers from pressing; and then said endless belts are allowed to move; said first transfer means being moved to a position conforming with said backward passage and said second transfer means being moved to a position conforming with said forward passage whereby permitting said first transfer means to move in the backward direction and said second transfer means to move in the forward direction after said first and second veneers are transferred between said pressing bodies but before said endless belts are actuated to move.

10. A veneer-pressing apparatus which comprises;

(a) pressing device comprising;

at least five pressing bodies disposed parallel with each other and made movable from a non-pressing position where said pressing bodies are vertically spaced apart from each other by a predetermined interval to a pressing position where said pressing bodies are close to each other;

endless belts each adapted to be intermittently moved along the upper surface and bottom surface of each of said pressing bodies and in a direction which is opposite to that of the neighboring endless belt, thereby forming a forward transfer passage between a pair of facing surfaces of the neighboring endless belts and a backward transfer passage between a pair of facing surfaces of the neighboring endless belts which is opposite in transferring direction to said forward transfer passage; and a pressing member which is capable of rendering said at least three pressing bodies provided with said endless belt to move from a non-pressing position where said pressing bodies are vertically spaced apart from each other by a predetermined interval so as to form said forward transfer passage and said backward transfer passage alternately between said pressing bodies to a pressing position where said pressing bodies are close to each other so as to press a veneer carried on each of said transfer passage with a predetermined pressure;

(b) a first transfer means disposed in conformity with and on an upstream side of said forward transfer passage in said pressing device, capable of intermittently moving in a forward direction conforming with a transferring direction of said forward transfer passage and also in a direction opposite to said forward direction, and provided with at least two transferring members which are spaced apart from each other by a distance corresponding to three stages of said pressing bodies as measured when said pressing bodies are positioned in said non-pressing position, said first transfer means being capable of being moved in vertical direction so that said transferring members conform with said forward passage or said backward passage;

(c) a second transfer means disposed in conformity with and on a downstream side of said forward transfer passage in said pressing device, capable of intermittently moving in said forward direction and also in a direction opposite to said forward direction, and provided with at least two transferring members which are spaced apart from each other by a distance corresponding to three stages of said pressing bodies as measured when said pressing bodies are positioned in said non-pressing position, said second transfer means being capable of being moved intertical direction so that said transferring members conform with said forward passage or said backward passage; and (d) a control means constituted by a control system wherein when each of the pressing bodies is moved to the non-pressing position and when the first and second transfer means are positioned to conform with the forward passage, the first and second transfer means are allowed to move in the forward direction, and at the same time each of the endless belts is allowed to move whereby transferring a first veneer placed in advance on each of said transferring members of the first transfer means to the forward transfer passage and then to each of said transferring members of the second transfer means; and then, the second transfer means carrying the first veneer is vertically move to conform with the backward transfer passage, and a second veneer is put in place on the first transfer means until the aforementioned vertical movement of the second transfer means carrying the first veneer to conform with the backward transfer passage is finished; and, under this condition, each of said transferring members of the first transfer means is allowed to move in the forward direction and each of said transferring members of the second transfer means is allowed to move in the backward direction, and at the same time, each of the endless belts is allowed to move whereby transferring the second veneer carried on each of said transferring members of the first transfer means to the forward transfer passage formed between the pressing bodies, while the first veneer carried on each of said transferring members of the second transfer means to the backward transfer passage formed between the pressing bodies; and then, the movement of the first and second transfer means and the endless belts is suspended, and under this condition, the pressing member is actuated to move the pressing bodies to the pressing position respectively, thereby performing the pressing of the first and second veneers for a predetermined period of time; and then a pressing action of said pressing member is released, whereby allowing each of said pressing bodies to move to said non-pressing position and releasing said first and second veneers from pressing; and then said endless belts are allowed to move; each of said transferring members of said first transfer means being moved to a position conforming with said backward passage and each of said transferring members of said second transfer means being moved to a position conforming with said forward passage whereby permitting each of said transferring members of said first transfer means to move in the backward direction and each of said transferring members of said second transfer means to move in the forward direction after said first and second veneers are transferred between said pressing bodies but before said endless belts are actuated to move, thereby transferring said first veneers on the backward transfer passage onto each of said transfer members of said first transfer means, and transferring said second veneers on the forward transfer passage onto each of said transfer members of said second transfer means.

* * * * *

UNITED STATES PATENT AND TRADEMARK OFFICE

CERTIFICATE OF CORRRECTION

PATENT NO. : 5,875,710
DATED : March 2, 1999
INVENTOR(S) : Noriyuki Honda, et al.

It is certified that error appears in the above-identified patent and that said Letters Patent is hereby corrected as shown below:

On the title page, item [56] add the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 4 | 0 | 6 | 5 | 0 | 0 | 3 | 12/27/77 | Hostettler | | | |
| | | | | | | | | | | | | | |

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | EP | 9 | 7 | 1 | 1 | 4 | 1 | 8 0 | 10/22/1998 | Europe | | | | |
| | DE | 1 | 6 | 5 | 3 | 3 | 4 | 2 | 03/19/1970 | Holland | | | | |
| | DE | 1 | 1 | 9 | 8 | 5 | 4 | 3 | 08/12/1965 | Holland | | | | |
| | FR | 2 | 3 | 0 | 9 | 3 | 3 | 0 | 11/26/1976 | France | | | | |
| | DE | 1 | 2 | 2 | 3 | 1 | 4 | 6 | 08/18/1966 | Holland | | | | |
| | 2 | 7 | 3 | 3 | 7 | 6 | 5 | | 02/15/1979 | Holland | | | | |
| | 4 | 2 | 0 | 1 | 4 | 7 | 5 | | 07/22/1993 | Holland | | | | |
| | | | | | | | | | | | | | | |

Signed and Sealed this

Twenty-sixth Day of October, 1999

*Attest:*

Q. TODD DICKINSON

*Attesting Officer*

*Acting Commissioner of Patents and Trademarks*